US008294017B2

(12) United States Patent
Veillet

(10) Patent No.: US 8,294,017 B2
(45) Date of Patent: Oct. 23, 2012

(54) PERSONALIZED MANDALA-MANTRA

(75) Inventor: Guy Veillet, Montréal (CA)

(73) Assignee: Yatsav Productions Inc., Montreal (CA)

( * ) Notice: Subject to any disclaimer, the term of this patent is extended or adjusted under 35 U.S.C. 154(b) by 221 days.

(21) Appl. No.: 12/289,305

(22) Filed: Oct. 24, 2008

(65) Prior Publication Data

US 2011/0088533 A1 Apr. 21, 2011

(51) Int. Cl.
*G10H 1/00* (2006.01)
*G10H 1/18* (2006.01)

(52) U.S. Cl. ..... 84/615; 84/601; 84/602; 84/618; 84/653; 84/656

(58) Field of Classification Search ..... None
See application file for complete search history.

(56) References Cited

U.S. PATENT DOCUMENTS

| | | | | |
|---|---|---|---|---|
| 6,974,325 | B2 * | 12/2005 | D'Zmura | 434/106 |
| 7,083,415 | B2 * | 8/2006 | D'Zmura | 434/106 |
| 7,195,488 | B2 * | 3/2007 | D'Zmura | 434/106 |
| 2004/0058300 | A1 * | 3/2004 | D'Zmura | 434/106 |
| 2009/0150489 | A1 * | 6/2009 | Davis et al. | 709/204 |
| 2009/0150514 | A1 * | 6/2009 | Davis et al. | 709/217 |
| 2009/0177484 | A1 * | 7/2009 | Davis et al. | 705/1 |
| 2009/0177745 | A1 * | 7/2009 | Davis et al. | 709/204 |
| 2010/0220197 | A1 * | 9/2010 | Dukellis et al. | 348/207.1 |
| 2011/0088533 | A1 * | 4/2011 | Veillet | 84/601 |

* cited by examiner

*Primary Examiner* — Marlo Fletcher
(74) *Attorney, Agent, or Firm* — Mathieu Audet

(57) ABSTRACT

A method for creating a personalized musical file is presented, the method comprising receiving a birth date, determining angular distribution of planets on a birth sky based, at least in part, on the birth date, selecting a plurality of Names from Shem ha-Meforash based, at least in part, on the angular distribution of planets, associating vowels with at least some of the Names, generating a recorded musical portion for at least some of the Names, assembling at least some of the recorded musical portions in a musical file and recording the musical file. A method for creating a personalized mandala and a personalized mantra is also presented herein.

19 Claims, 22 Drawing Sheets

302 312 314 316

300

| | 302 | 304 | 306 | 308 |
|---|---|---|---|---|
| N1-N19-N37-N55 | 318 וְהֵוִיָּה | 320 לְוִיָּה | 322 אָנִיאָל | 324 מְבַהִיָּה |
| N2-N20-N38-N56 | יֵלִיאֵל | פֵּהֲלִיָּה | חֵעְמִיָּה | פּוּיָאֵל |
| N3-N21-N39-N57 | סִיטָאֵל | נְלְכָּאֵל | רְהָעֵאל | נְמָמִיָּה |
| N4-N22-N40-N58 | עֲלָמִיָּה | יֵיעֵאל | יֵיזֵאל | יֵילֵאל |
| N5-N23-N41-N59 | מָהֲשִׁיָּה | מְלֶהאֵל | הָהֶהאֵל | הָרְחאֵל |
| N6-N24-N42-N60 | לֵלֹהאֵל | חֲחוּיָה | מֵיכָאֵל | מֵצְרְאֵל |
| N7-N25-N43-N61 | אוֹכְאִיָּה | נִתְהַיָּה | וּלְיָה | וּמְבָאֵל |
| N8-N26-N44-N62 | כְּהַתָּאֵל | הָאֲאַיָּה | יְלֵהאֵל | יְהֵהאֵל |
| N9-N27-N45-N63 | הֲזַיאֵל | יֵרָתאֵל | סְאַלְיָה | עֲנוּאֵל |
| N10-N28-N46-N64 | אַלְדָיָה | שְׁאָהַיָּה | עֲרָיאֵל | מַחֲיָאֵל |
| N11-N29-N47-N65 | לָאוּיָה | רְיָיאֵל | עֲשַׁלְיָה | דְּמַבִּיָּה |
| N12-N30-N48-N66 | הַהֲעִיָּה | אוּמָאֵל | מִיהָאֵל | מְנַקְאֵל |
| N13-N31-N49-N67 | יְזֵלֵאל | לְכָבֵאל | וְהוּאֵל | אִיעֵאל |
| N14-N32-N50-N68 | מְבַהֵאל | וְשַׁרְיָה | דַּנְיָאֵל | חֲבַוְיָה |
| N15-N33-N51-N69 | הֲרָיאֵל | יְחוּיָה | הֲחַשְׁיָה | רְאָהֵאל |
| N16-N34-N52-N70 | הָקַמְיָה | לָהֲחִיָּה | עֲמָמִיָּה | יָבָמִיָּה |
| N17-N35-N53-N71 | לָאוּיָה | כָּוְקִיָּה | נְנָאֵאל | הָיָיאֵל |
| N18-N36-N54-N72 | כְּלִיאֵל | מְנַדֵּאל | נִיתֵאל | מְוֻמִיָּה |

FIG. 7

| Planet | P1 | P2 | P3 | P4 | P5 | P6 | P7 | P8 | P9 | P10 |
|---|---|---|---|---|---|---|---|---|---|---|
| Name | N71 | N51 | N1 | N4 | N60 | N66 | N1 | N31 | N8 | N11 |

GENESIS 1 : 1

בְּרֵאשִׁית בָּרָא אֱלֹהִים אֵת הַשָּׁמַיִם וְאֵת הָאָרֶץ

בראשית ברא אלהים את השמים ואת הארץ

480 482 484 486

492

| | | | |
|---|---|---|---|
| 1 | V1-V5 | V1 sheva ; V2 tséré ; V3 hiriq ; V4 qamats ; V5 qamats | E-É-I-A-A) |
| 2 | V2-V6 | V2 tséré ; V3 hiriq ; V4 qamats ; V5 qamats ; V6 sègol | (É-I-A-A-È) |
| 3 | V3-V7 | V3 hiriq ; V4 qamats ; V5 qamats ; V6) sègol ; V7) holem | (I-A-A-È-O) |
| 4 | V4-V8 | V4 qamats ; V5 qamats ; V6 sègol ; V7 holem ; V8 hiriq | (A-A-È-O-I) |
| 5 | V5-V9 | V5 qamats ; V6 sègol ; V7 holem ; V8 hiriq ; V9 tséré | (A-È-O-I-É) |
| 6 | V6-V10 | V6 sègol ; V7 holem ; V8 hiriq ; V9 tséré ; V10 patah | (È-O-I-É-À) |
| 7 | V7-V11 | V7 holem ; V8 hiriq ; V9 tséré ; V10 patah ; V11 qamats | (O-I-É-À-A) |
| 8 | V8-V12 | V8 hiriq ; V9 tséré ; V10 patah ; V11 qamats ; V12 patah | (I-É-À-A-À) |
| 9 | V9-V13 | V9 tséré ; V10 patah ; V11 qamats ; V12 patah ; V13 hiriq | (É -À-A-À-I) |
| 10 | V10-V14 | V10 patah ; V11 qamats ; V12 patah ; V13 hiriq ; 14 sheva | (À-A-À-I-E) |
| 11 | V11-V15 | V11 qamats ; V12 patah ; V13 hiriq ; V14 sheva ; V15 tséré | (A-À-I-E-É) |
| 12 | V12-V16 | V12 patah ; V13 hiriq ; V14 sheva ; V15 tséré ; V16 qamats | (À-I-E-É-A) |
| 13 | V13-V17 | V13 hiriq ; V14 sheva ; V15 tséré ; V16 qamats; V17 qamats | (I-E-É-A-A) |
| 14 | V14-V18 | V14 sheva ; V15 tséré ; V16 qamats; V17 qamats; V18 tsèré | (E-É-A-A-È) |
| 15 | V15-V1 | V15 tséré ; V16 qamats ; V17 qamats ; V18 tsèré ; V1 sheva | (É-A-A-È-E) |
| 16 | V16-V2 | V16 qamats ; V17 qamats ; V18 tsèré ; V1 sheva ; 2 tséré | (A-A-È-E-É) |
| 17 | V17-V3 | V17 qamats ; V18 tsèré ; V1 sheva ; V2 tséré ; V3 hiriq | (A-È-E-É-I) |
| 18 | V18-V4 | V18 sègol ; V1 sheva ; V2 tséré ; V3 hiriq ; V4 qamats | (È-E-É-I-A) |

Fig. 21

480

490

492

| | | | | |
|---|---|---|---|---|
| 1 | N1 | N19 | N37 | N55 |
| 2 | N2 | N20 | N38 | N56 |
| 3 | N3 | N21 | N39 | N57 |
| 4 | N4 | N22 | N40 | N58 |
| 5 | N5 | N23 | N41 | N59 |
| 6 | N6 | N24 | N42 | N60 |
| 7 | N7 | N25 | N43 | N61 |
| 8 | N8 | N26 | N44 | N62 |
| 9 | N9 | N27 | N45 | N63 |
| 10 | N10 | N28 | N46 | N64 |
| 11 | N11 | N29 | N47 | N65 |
| 12 | N12 | N30 | N48 | N66 |
| 13 | N13 | N31 | N49 | N67 |
| 14 | N14 | N32 | N50 | N68 |
| 15 | N15 | N33 | N51 | N69 |
| 16 | N16 | N34 | N52 | N70 |
| 17 | N17 | N35 | N53 | N71 |
| 18 | N18 | N36 | N54 | N72 |

FIG. 22

PERSONALIZED MANDALA-MANTRA

BACKGROUND OF THE INVENTION

1. Field of the Invention

This invention relates generally to a method to produce a personalized mandala and a personalized mantra. More specifically, the present invention relates to a computerized system adapted to produce a personalized mandala and a personalized mantra.

2. Description of the Related Art

Mandalas and mantras have been known and used throughout history since a long time. Generally, mandalas and mantras are helpful to slow down and focus one's mental activity in order to reach a calm and peaceful state of mind.

Mandalas are known as a graphic mystic symbol of the universe that is typically in the form of a circle enclosing a square and often bearing symmetrically arranged representations of deities and is used chiefly in Hinduism and Buddhism as an aid to meditation.

Mantras are known as a Vedic hymn or prayer, a verbal spell, ritualistic incantation, or mystic formula used devotionally in popular Hinduism and Mahayana Buddhism.

The mandala and the mantra are two distinct elements that are coming from a different source.

Many people are using the same mandala and/or the same mantra for their spiritual practice. Some mandalas and some mantras are very well known. For example, the mantra "Ohm" has been known for centuries. It is one of the greatest of all mantras it is the representation of the Supreme Being. The past, present and the future are all included in this one sound. Meditation on this sacred syllable is said to satisfy every need and leads to liberation.

Nowadays people are in quest of their inner peace more than ever before. Publicity, speed of life, stress at work, fast food and electronic stimulation of all kinds are additional elements preventing people from connecting with their true self. The use of a mandala and/or a mantra would be beneficial to most people to help them refocus on their internal state.

An improved mandala and an improved mantra are therefore desirable over the existing art.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

Therefore, a first object of the present invention provides an individualized mandala.

Another object of the present invention provides an individualized mantra.

One object of the present invention provides an individualized mandala created in consideration of the date of birth of a person.

One other object of the present invention provides an individualized mantra created in consideration of the date of birth of a person.

One other object of the present invention provides an individualized mandala created in consideration of the localization of the planets in a birth sky in accordance with the date of birth of a person.

One other object of the present invention provides an individualized mantra created in consideration of the localization of the planets in a birth sky in accordance with the date of birth of a person.

Another object of the present invention provides a mandala and a mantra that are affiliated.

An aspect of the present invention provides a mandala that is based, at least in part, on a distribution of the 72 Names of Shem ha-Meforash on a geometric pattern and in conjunction with the position of planets in one's birth sky.

An aspect of the present invention provides a mantra using sounds that are based, at least in part, on the vocalization of a number of Names selected from the 72 Names of Shem ha-Meforash.

One other aspect of the present invention provides a mandala distributing a plurality of Names selected from the 72 Names of Shem ha-Meforash on a circle bordered by another geometric pattern.

One additional aspect of the present invention provides a mantra constructed on a musical template defining the localization of several recited Names of the Shem ha-Meforash over the duration of the mantra.

An additional aspect of the present invention provides a mantra that is offered in various durations.

Another aspect of the present invention provides a method to build a mantra comprising the distribution of several Names of Shem ha-Meforash modules having a similar length.

An aspect of the present invention provides vocalized Names of Shem ha-Meforash that are using vowels extracted from Genesis 1:1 in the Hebraic language and applied to Names of the Shem ha-Meforash.

Another aspect of the present invention provides vocalized Names of Shem ha-Meforash that are using sets of 5 consecutive vowels extracted from Genesis 1:1 in the Hebraic language.

One aspect of the present invention provides a server adapted to receive a birth date and adapted to calculate, produce and download to a client a personalized mantra.

Another aspect of the present invention provides a method to correlate Names of Shem ha-Meforash, vowels of Genesis 1:1 in Hebraic language and a date. Another aspect of the present invention provides a method for creating a personal mandala comprising selecting at least one sequence of characters based on a birth date; associating the selected at least one sequence of characters with a position on a graphical layout; and displaying the positioned at least one associated sequence of characters.

One other aspect of the present invention providers a method for creating a mantra comprising selecting a plurality of Names from the 72 Names of Shem ha-Meforash; associating at least one of the plurality of Names with vowels; including the plurality of Names in the mantra.

Another aspect of the present invention provides a method for creating a personalized musical file comprising receiving a birth data; determining an angular distribution of planets on a birth sky based, at least in part, on the birth data; selecting a plurality of sequences of characters based, at least in part, on the angular distribution of planets; generating a recorded musical portion for at least some of the plurality of sequences of characters; assembling at least some of the recorded musical portions in a musical file; and recording the musical file These and other advantages and features of the present invention will become apparent from the following description and the attached drawings.

BRIEF DESCRIPTION OF THE DRAWINGS

FIG. 7 is a table indicating the numbers associated with each of the 72 Names of Shem ha-Meforash;

FIG. 21 is a table presenting various sequences of five consecutive vowels from the vowels from the Hebraic version of Genesis 1:1 of FIG. 20;

FIG. 22 is a table showing the correspondence between each set of vowels of FIG. 21 and the Names of Shem ha-Meforash of FIG. 7.

DESCRIPTION OF EMBODIMENT(S) OF THE INVENTION

Figure 1:
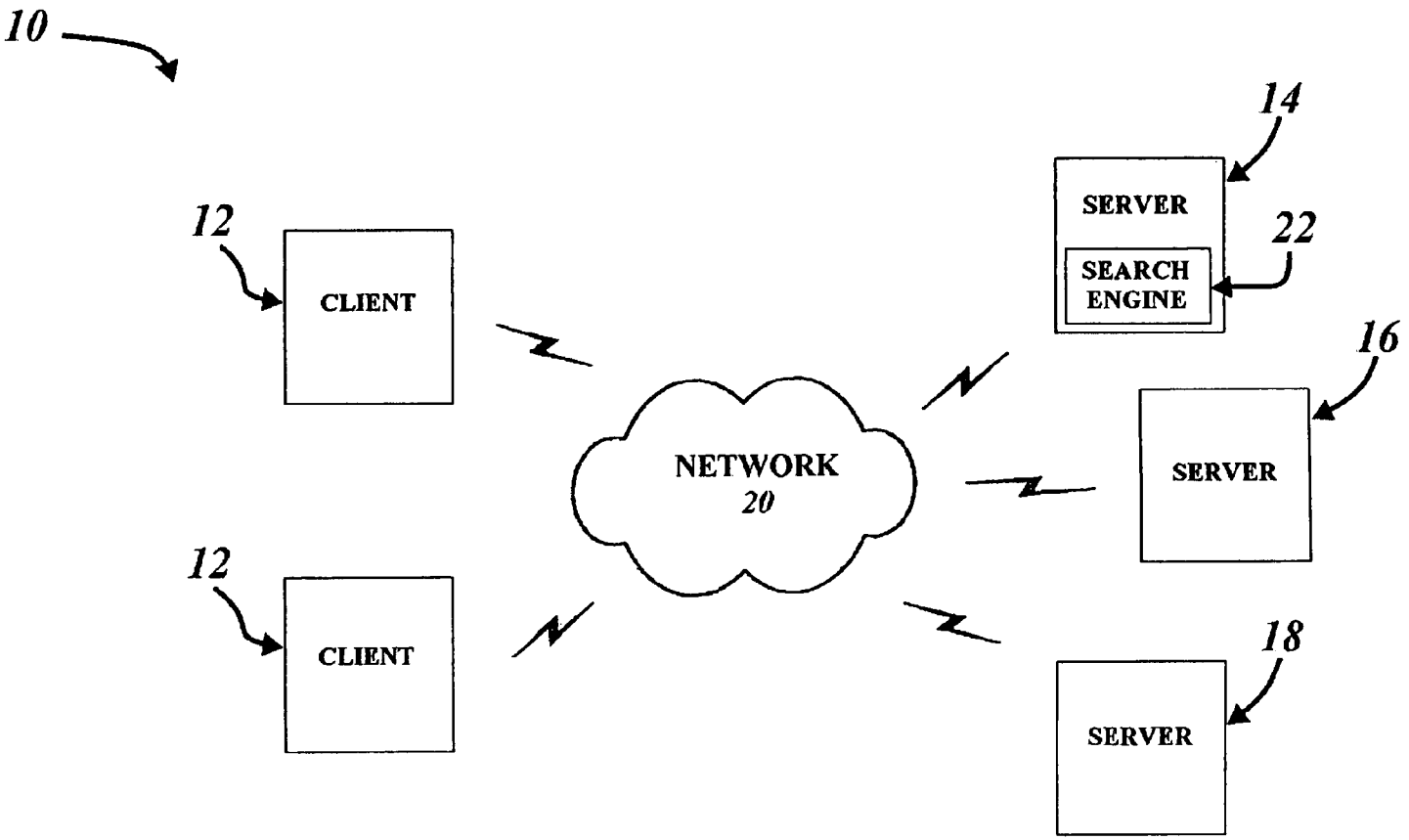
FIG. 1 is a schematic view of a computer network.

The present invention is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The features provided in this specification mainly relates to basic principles for creating a personalized mandala and a personalized mantra. This specification also covers computer software and machine-readable code/instructions adapted to create a personalized mandala and a personalized mantra. These code/instructions are preferably stored on a machine-readable medium to be read and acted upon with a computer or a machine having the appropriate code/instructions reading capability.

Exemplary Network

FIG. 1 illustrates an exemplary network 10 in which a system and method, consistent with the present invention, may be implemented. The network 10 may include multiple client devices 12 connected to multiple servers 14, 16, 18 via a network 20. The network 20 may include a local area network (LAN), a wide area network (WAN), a telephone network, such as the Public Switched Telephone Network (PSTN), an intranet, the Internet, Wi-Fi, WiMAX or a combination of networks. Two client devices 12 and three servers 14, 16, 18 have been illustrated as connected to network 20 for simplicity. In practice, there may be more or less client devices and servers. Also, in some instances, a client device may perform the functions of a server and a server may perform the functions of a client device.

The client devices 12 may include devices, such as mainframes, minicomputers, personal computers, laptops, personal digital assistants, telephones, or the like, capable of connecting to the network 20. The client devices 12 may transmit data over the network 20 or receive data from the network 20 via a wired, wireless, or optical connection.

The servers 14, 16, 18 may include one or more types of computer systems, such as a mainframe, minicomputer, or personal computer, capable of connecting to the network 20 to enable servers 14, 16, 18 to communicate with the client devices 12. In alternative implementations, the servers 14, 16, 18 may include mechanisms for directly connecting to one or more client devices 12. The servers 14, 16, 18 may transmit data over network 14 or receive data from the network 20 via a wired, wireless, or optical connection.

In an implementation consistent with the present invention, the server 14 may include a search engine 22 usable by the client devices 12. The servers 14 may store documents, such as web pages, accessible by the client devices 12.

Figure 2:
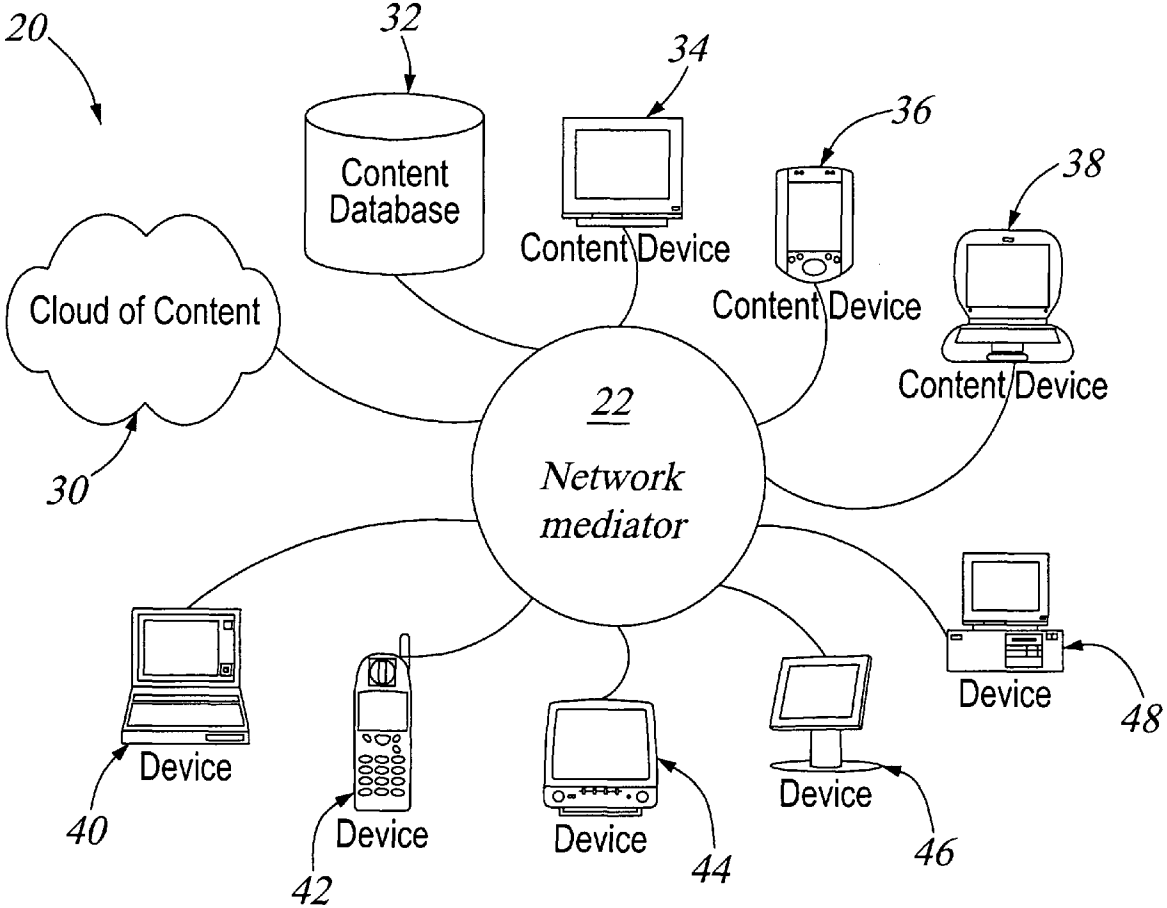
FIG. 2 is a schematic view of a computer network.

With reference to FIG. 2, a network 20 includes the content cloud 30, a content database 32, content devices 34-38, and devices 40-48. The network mediator 22 enables the network devices 32-38 to communicate with each other without preconfiguring each device.

The content cloud 30 represent a content source such as the Internet, where content exists at various locations across the globe. The content includes multimedia content such as audio and video. The mediator 22 allows the content cloud to provide content to devices 40-48.

The content database 32 is a storage device that maintains content. The content database 32 may be a stand-alone device on an external communication network. The mediator 22 communicates with the content database 32 to access and retrieve content.

The content devices 34-38 include intelligent devices, such as, for example, personal computers, laptops, cell phones and personal digital assistants. The content devices 32-38 are capable or storing content information.

The devices 40-48 are intelligent devices that receive content from a content source 30-38. However, the devices 30-38 can also operate as servers to distribute content to other client devices.

Exemplary Client Architecture

Figure 3:
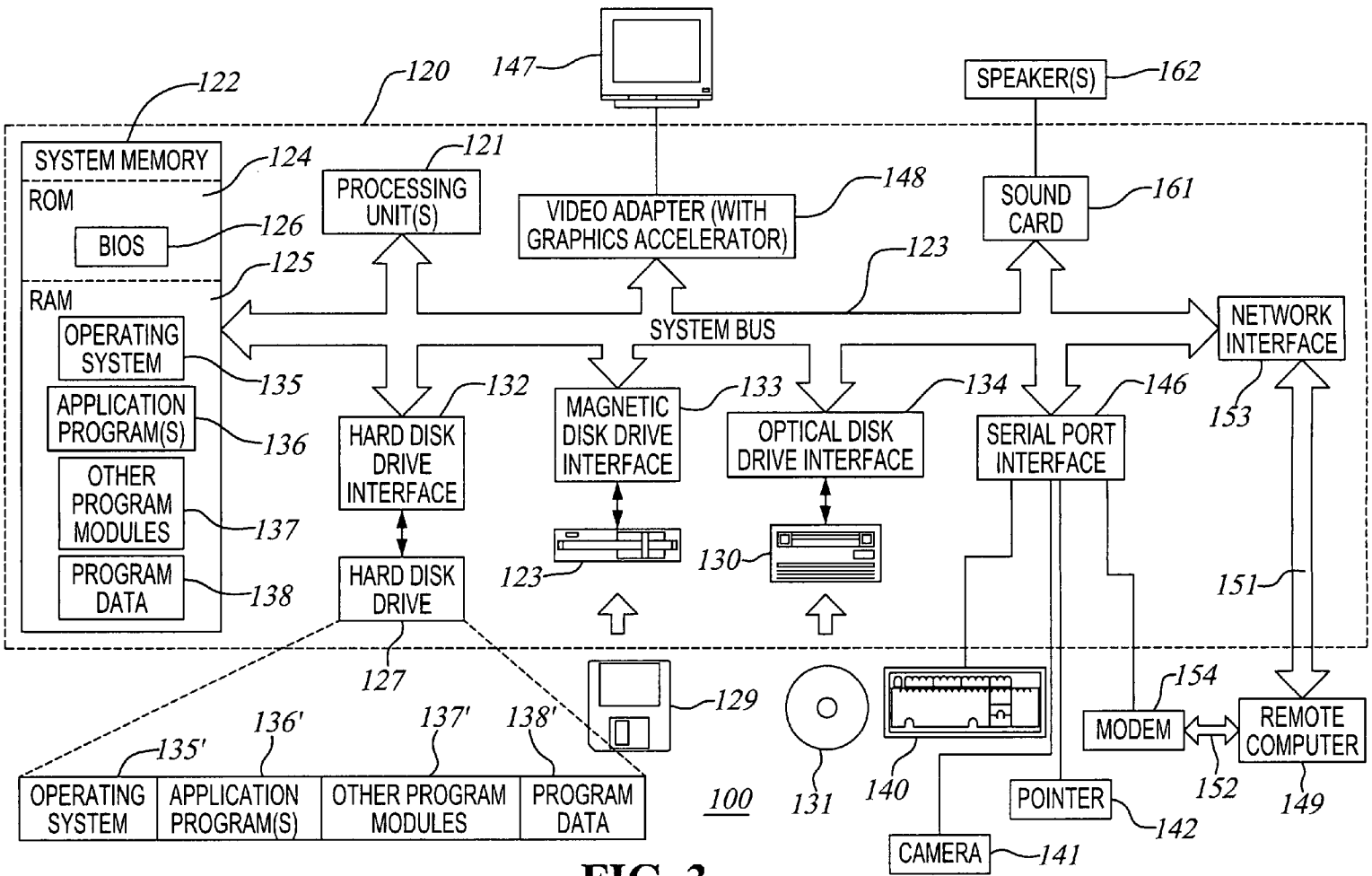
FIG. 3 is a schematic view of a computer system.

FIG. 3 and the following discussion provide a brief, general description of an exemplary apparatus in which at least some aspects of the present invention may be implemented. The present invention will be described in the general context of computer-executable instructions, such as program modules, being executed by a personal computer. However, the methods of the present invention, may be effected by other apparatus. Program modules may include routines, programs, objects, components, data structures, applets, WEB 2.0 type of evolved networked centered applications, etc. that perform a task(s) or implement particular abstract data types. Moreover, those skilled in the art will appreciate that at least some aspects of the present invention may be practiced with other configurations, including hand-held devices, multiprocessor systems, microprocessor-based or programmable consumer electronics, network computers, minicomputers, set top boxes, mainframe computers, gaming console and the like. At least some aspects of the present invention may also be practiced in distributed computing environments where tasks are performed by remote processing devices linked through a communications network. In a distributed computing environment, program modules may be located in local and/or remote memory storage devices.

With reference to FIG. 3, an exemplary apparatus 100 for implementing at least some aspects of the present invention includes a general purpose computing device in the form of a conventional personal computer 120. The personal computer 120 may include a processing unit 121, a system memory 122, and a system bus 123 that couples various system components, including the system memory 122, to the processing unit 121. The system bus 123 may be any of several types of bus structures including a memory bus or memory controller, a peripheral bus, and a local bus using any of a variety of bus architectures. The system memory may include read only memory (ROM) 124 and/or random access memory (RAM) 125. A basic input/output system 126 (BIOS), containing basic routines that help to transfer information between elements within the personal computer 120, such as during start-up, may be stored in ROM 124. The personal computer 120 may also include a hard disk drive 127 for reading from and writing to a hard disk, (not shown), a magnetic disk drive 128 for reading from or writing to a (e.g., removable) magnetic disk 129, and an optical disk drive 130 for reading from or writing to a removable (magneto) optical disk 131 such as a compact disk or other (magneto) optical media. The hard disk drive 127, magnetic disk drive 128, and (magneto) optical disk drive 130 may be coupled with the system bus 123 by a hard disk drive interface 132, a magnetic disk drive interface 133, and a (magneto) optical drive interface 134, respectively. The drives and their associated storage media provide non-volatile (or persistent) storage of machine readable instructions, data structures, program modules and other data for the personal computer 120. Although the exemplary environment described herein employs a hard disk, a removable magnetic disk 129 and a removable optical disk 131, those skilled in the art will appreciate that other types of storage media, such as magnetic cassettes, flash memory cards, digital video disks, Bernoulli cartridges, random access memories (RAMs), read only memories (ROM), and the like, may be used instead of, or in addition to, the storage devices introduced above.

A number of program modules may be stored on the hard disk 127, magnetic disk 129, (magneto) optical disk 131, ROM 124 or RAM 125, such as an operating system 135 (for example, Windows® NT.RTM. 4.0, sold by Microsoft® Corporation of Redmond, Wash.), one or more application programs 136, other program modules 137 (such as "Alice", which is a research system developed by the User Interface Group at Carnegie Mellon University available at www.Alice.org, OpenGL from Silicon Graphics Inc. of Mountain View Calif., or Direct 3D from Microsoft Corp. of Bellevue Wash.), and/or program data 138 for example.

A user may enter commands and information into the personal computer 120 through input devices, such as a keyboard 140, a camera 141 and pointing device 142 for example. Other input devices (not shown) such as a microphone, joystick, game pad, satellite dish, scanner, a touch sensitive screen, accelerometers adapted to sense movements of the user or movements of a device, or the like may also be included. These and other input devices are often connected to the processing unit 121 through a serial port interface 146 coupled to the system bus. However, input devices may be connected by other interfaces, such as a parallel port, a game port, blue tooth connection or a universal serial bus (USB). For example, since the bandwidth of the camera 141 may be too great for the serial port, the video camera 141 may be coupled with the system bus 123 via a video capture card (not shown). The video monitor 147 or other type of display device may also be connected to the system bus 123 via an interface, such as a video adapter 148 for example. The video adapter 148 may include a graphics accelerator. One or more speaker 162 may be connected to the system bus 123 via a sound card 161 (e.g., a wave table synthesizer such as product number AWE64 Gold Card from Creative® Labs of Milpitas, Calif.). In addition to the monitor 147 and speaker(s) 162, the personal computer 120 may include other peripheral output devices (not shown), such as a printer for example. As an alternative or an addition to the video monitor 147, a stereo video output device, such as a head mounted display or LCD shutter glasses for example, could be used.

The personal computer 120 may operate in a networked environment which defines logical connections to one or more remote computers, such as a remote computer 149. The remote computer 149 may be another personal computer, a server, a router, a network PC, a peer device or other common network node, and may include many or all of the elements described above relative to the personal computer 120, although only a memory storage device has been illustrated in FIG. 1. The logical connections depicted in FIG. 1 include a local area network (LAN) 14 and a wide area network (WAN) 152 (shown in FIG. 3), an intranet and the Internet.

When used in a LAN, the personal computer 120 may be connected to the LAN 14 through a network interface adapter (or "NIC") 153. When used in a WAN, such as the Internet, the personal computer 120 may include a modem 154 or other means for establishing communications over the wide area network 152 (e.g. Wi-Fi, WiMax). The modem 154, which may be internal or external, may be connected to the system bus 123 via the serial port interface 146. In a networked environment, at least some of the program modules depicted relative to the personal computer 120 may be stored in the remote memory storage device. The network connections shown are exemplary and other means of establishing a communications link between the computers may be used.

General Steps to Produce a Personalized Mandala and/or Mantra

Figure 4:
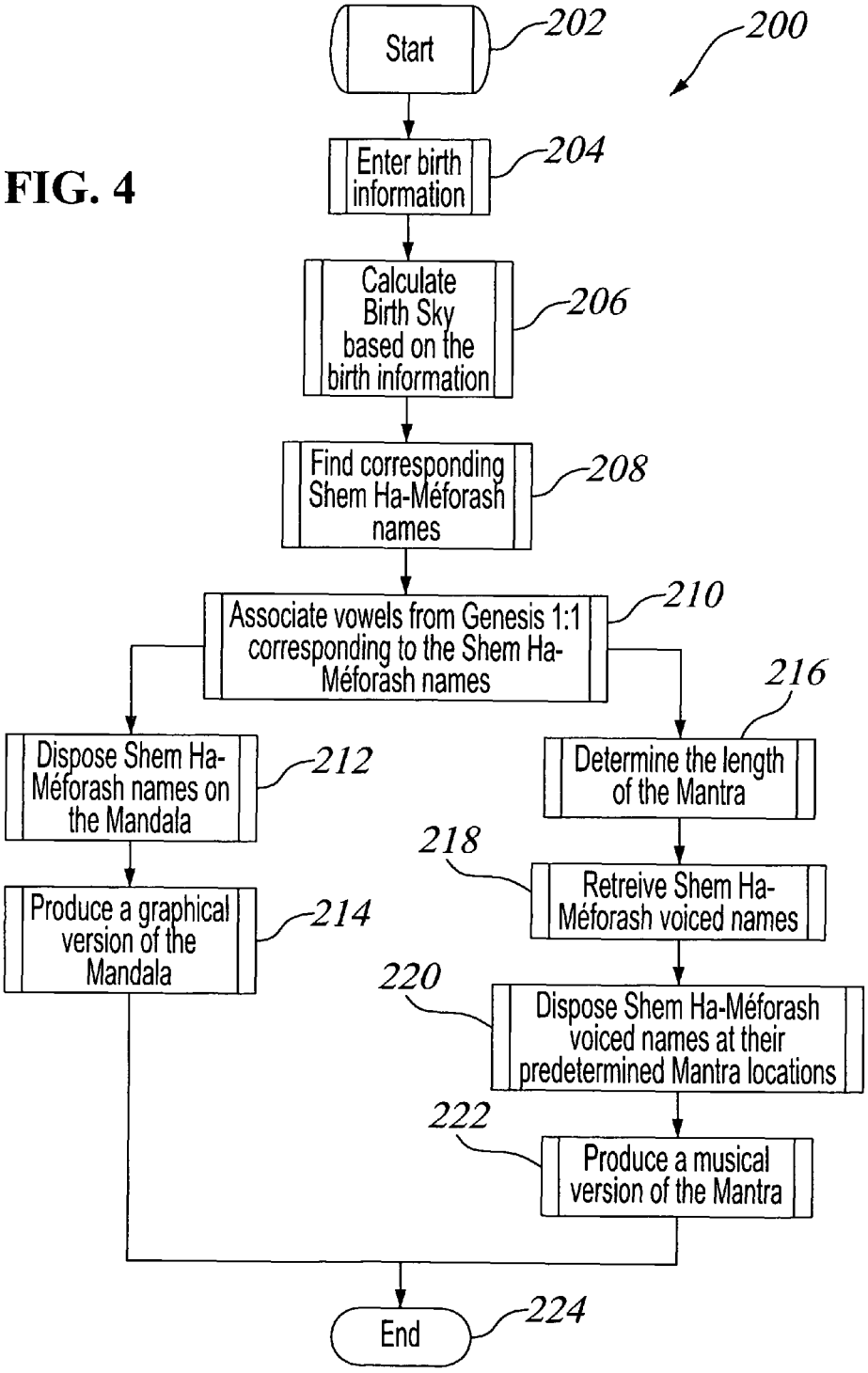
FIG. 4 is a flow chart illustrating the general steps of the creation of a mandala and a mantra.

FIG. 4 is a flow chart illustrating general steps 200 to produce a mandala and a mantra in accordance with the present invention. Some steps are considerably condensed on FIG. 4 and will be explained in greater details later in this specification.

The process starts 202 with entering one's birth date 204. The birth date is used to calculate the position of the planets in one's birth sky 206 (the birth sky being also referred to the Zodiac). Then, positions of the planets found at step 206 are used to determine corresponding Shem ha-Meforash Names 208 in the Hebraic language. Next, vowels extracted from a biblical passage, in the present situation Genesis 1:1 in Hebraic language, are associated 210 with the corresponding Shem ha-Meforash Names. Vowels are associated 210 to the consonants in the predetermined Shem ha-Meforash Names to produce a vocalization of each Names.

Then, to create the mandala, the predetermined Names of the Shem ha-Meforash are disposed 212 on a mandala layout to produce 214 a graphical rendering of the personified mandala.

On the other side, the length of the mantra is selected 216 among several possible lengths. The vocalized Names of the Shem ha-Meforash that have been determined from step 208 are retrieved 218. The vocalized Names are then disposed on a specific predetermined portion of the mantra 220 to produce a musical version of the mantra 222. After this process has ended 224 a personalized mandala and a personalized mantra have been created on the basis of the date of birth of a specific person.

Figure 5:
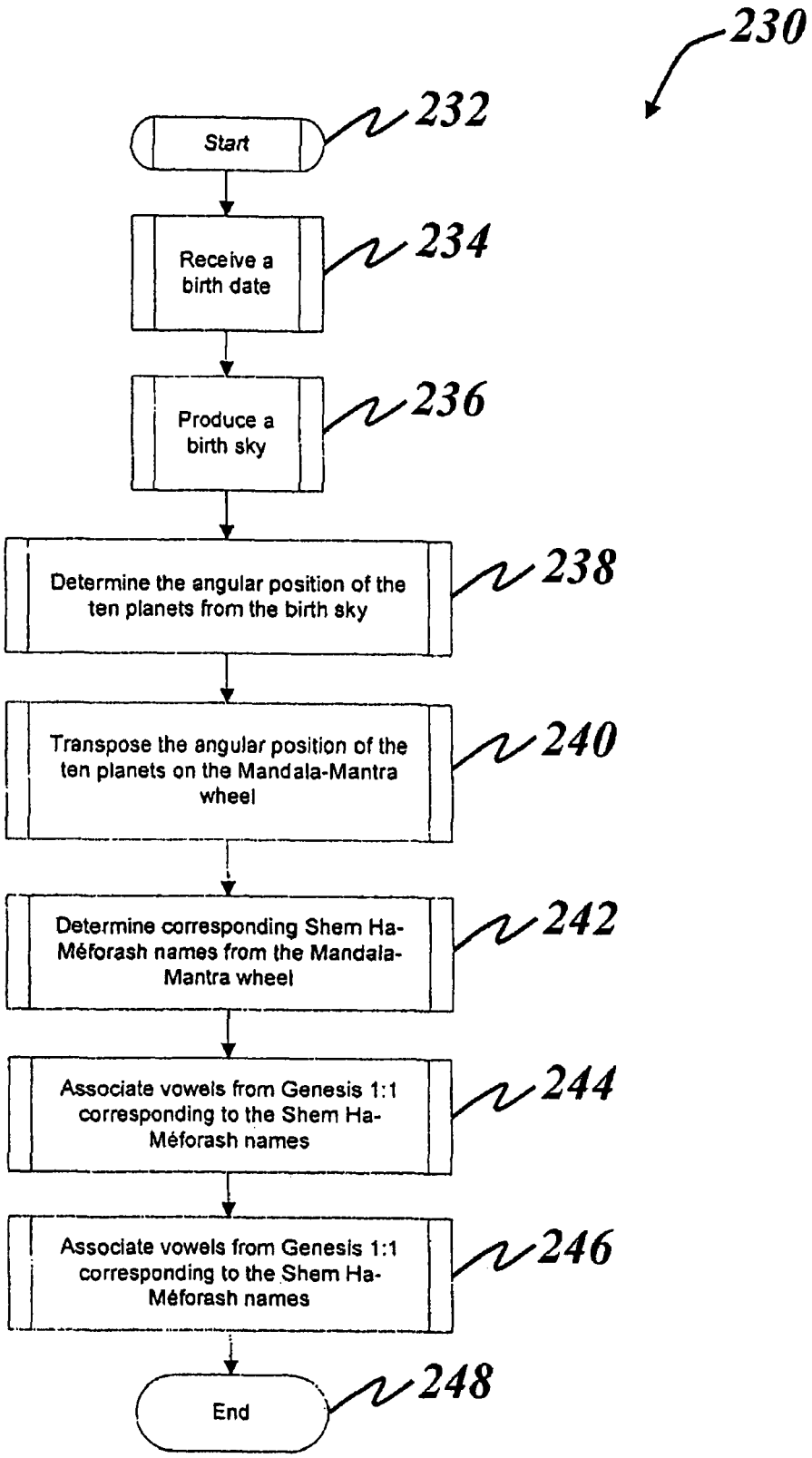
FIG. 5 is a flow chart illustrating the general steps of the correlation between a birth sky and the selection of the right Names of Shem ha-Meforash.

FIG. 5 illustrates in more depth the process 230 leading to the selection of specific Names of the Shem ha-Meforash and to specific vowels associated therewith. The process starts 232 with a birth date 234 of a person and producing a birth sky 236 associated with the birth date. Positions of the planets on the birth sky are defined 238. Then the position of each of the planets from the birth sky is transposed to the mandala-mantra correspondence wheel 240 to determine a series of corresponding Shem ha-Meforash Names 244. Finally, vowels from the selected biblical passage, in Hebraic language, in the present situation Genesis 1:1, are extracted from the biblical passage and applied to the corresponding Shem ha-Meforash Names 246 to vocalize the Names before the process ends 248.

Figure 6:
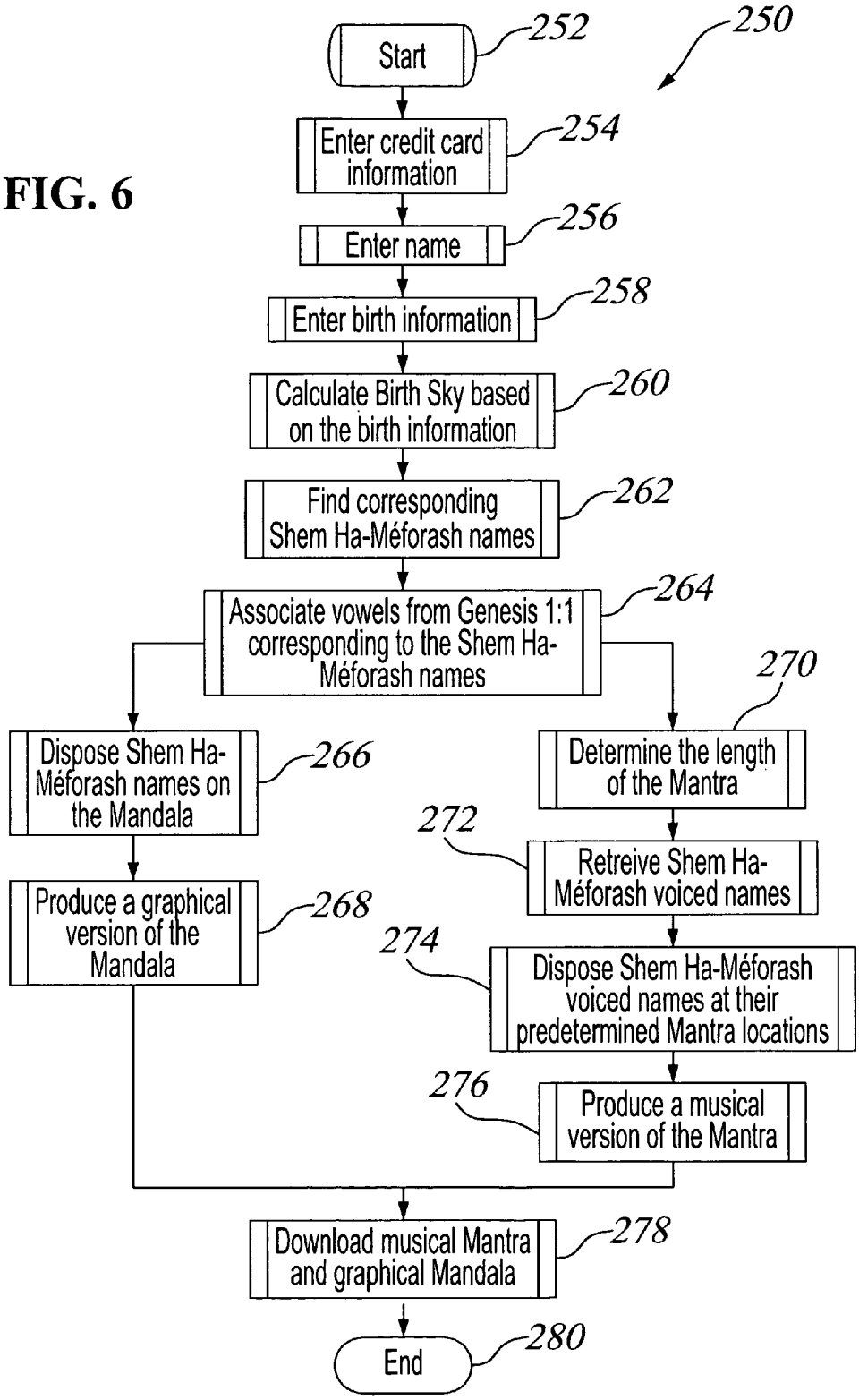
FIG. 6 is a flow chart illustrating the general steps of the selling process of an automatized production of a personalized mandala and/or mantra.

Referring now to FIG. 6 where a business process using an automated computerized creation of a personalized mandala and/or a personalized mantra 250 is illustrated. The process begins with step 252. A credit card number is entered by a user 254 with the name of the user 256. The birth information (e.g. the birth date and the birth location) is used 258 to calculate the birth sky of the user 260. Once the birth sky is calculated corresponding Shem ha-Meforash Names 262 are determined and vowels extracted from the biblical passage, Genesis 1:1, are associated with the corresponding Names of Shem ha-Meforash. As explained in a previous flow chart, the written corresponding Names of the Shem ha-Meforash are disposed on a mandala template 266 to produce a graphical version of the mandala 268.

Still on FIG. 6, referring to the mantra, the user can determine the desired length of the mantra 270 among several possible predetermined lengths or get all the various versions available of the mantra. The corresponding vocalized Names of Shem ha-Meforash are retrieved 272 from a bank of prerecorded vocalized 72 Names of Shem ha-Meforash. The corresponding vocalized Names are disposed on a mantra template 274 to produce a musical version of the mantra 276. The user finally downloads the musical mantra and/or the graphical mandala 278 before the sequence ends 280.

It is understood that the illustrated steps can be interchanged in a commercial embodiment without departing from the scope of the present invention.

The Shem ha-Meforash

Shem ha-Meforash is an ancient tannaitic name of the Tetragrammaton. The exact meaning of the term is somewhat obscure; but since the Tetragrammaton is called also "Shem ha-Meyuhad", it may be assumed that "meyuhad" is used elsewhere in the terminology of the tannaitic schools as a synonym for "meforash," both words designating something which is distinguished by a characteristic sign from other objects of its kind (see Bather, "Die Aelteste Terminologie der Jüdischen Schriftauslegung," p. 71). In connection with "shem" (="the name [of God]"), both terms mean also "pre-eminent." "Shem ha-Meforash," therefore, denotes the name of God which differs from all the other Names applied to Him, and is, consequently, the excellent name, the Tetragrammaton. In the old exegesis of Num 6:27 ("my name") one version (Sifre ad lot.) has "Shem ha-Meforash"; the other (Sotah 38*a*), "Shem ha-Meyuhad."

Information regarding the history of Shem ha-Meforash can be easily found in literature like on the following website: http://www.hebrew4christians.com/Names of G-d/Esoteric/esoteric.html (note that, in the event the website is not accessible in the future, a version of the web site can be retrieved at http://www.archive.orq).

In the present situation we will focus on the Shem ha-meforash considered as the seventy-two (72) Names of God derived from permutations on Exodus 14:19-21. The 72 Names are illustrated on FIG. 7. The first column 300 illustrates the associated Name's number used throughout the current specification. The first number (N1) 310 in the first box of column 300 relates to the first name 318 of the second column 302, the second number (N19) 312 in the first box of column 300 relates to the second name 320, the third number (N37) 314 in the first box of column 300 relates to the third name 322 and the fourth number (N55) 316 in the first box of column 300 relates to the fourth name 324. The same logic is applied on the subsequent lines of the table illustrated on FIG. 7. The Names will be referred to by their identification number that is preceded by a capital N.

Figures 18, 19, 20:
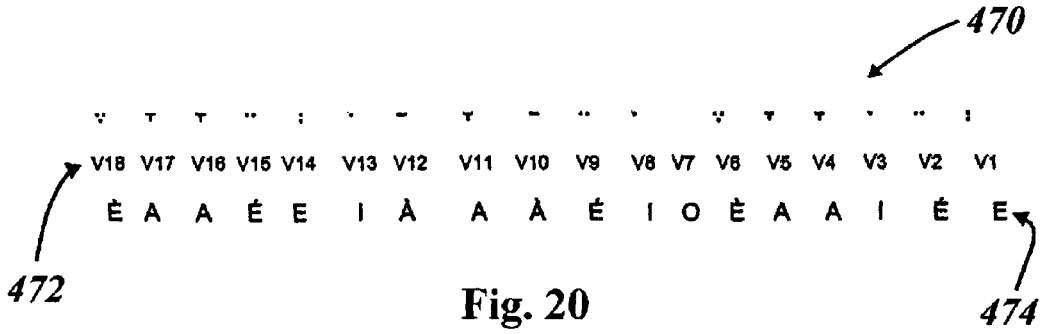
FIG. 18 is the text of the Hebraic version of Genesis 1:1 with the consonants and their associated vowels.
FIG. 19 is the text of the Hebraic version of Genesis 1:1 with only the consonants.
FIG. 20 is the extracted vowels from the Hebraic version of Genesis 1:1 with their associated order and their associated sound.

It is also possible to appreciate that each Name in the table of FIG. 7 is already associated with its corresponding set of vowels in (or from) Gen.1:1 (see FIG. 20). The association between the vowels and the Names will be explained later in this specification.

The Mandala-Mantra Correspondence Wheel

Figure 8:
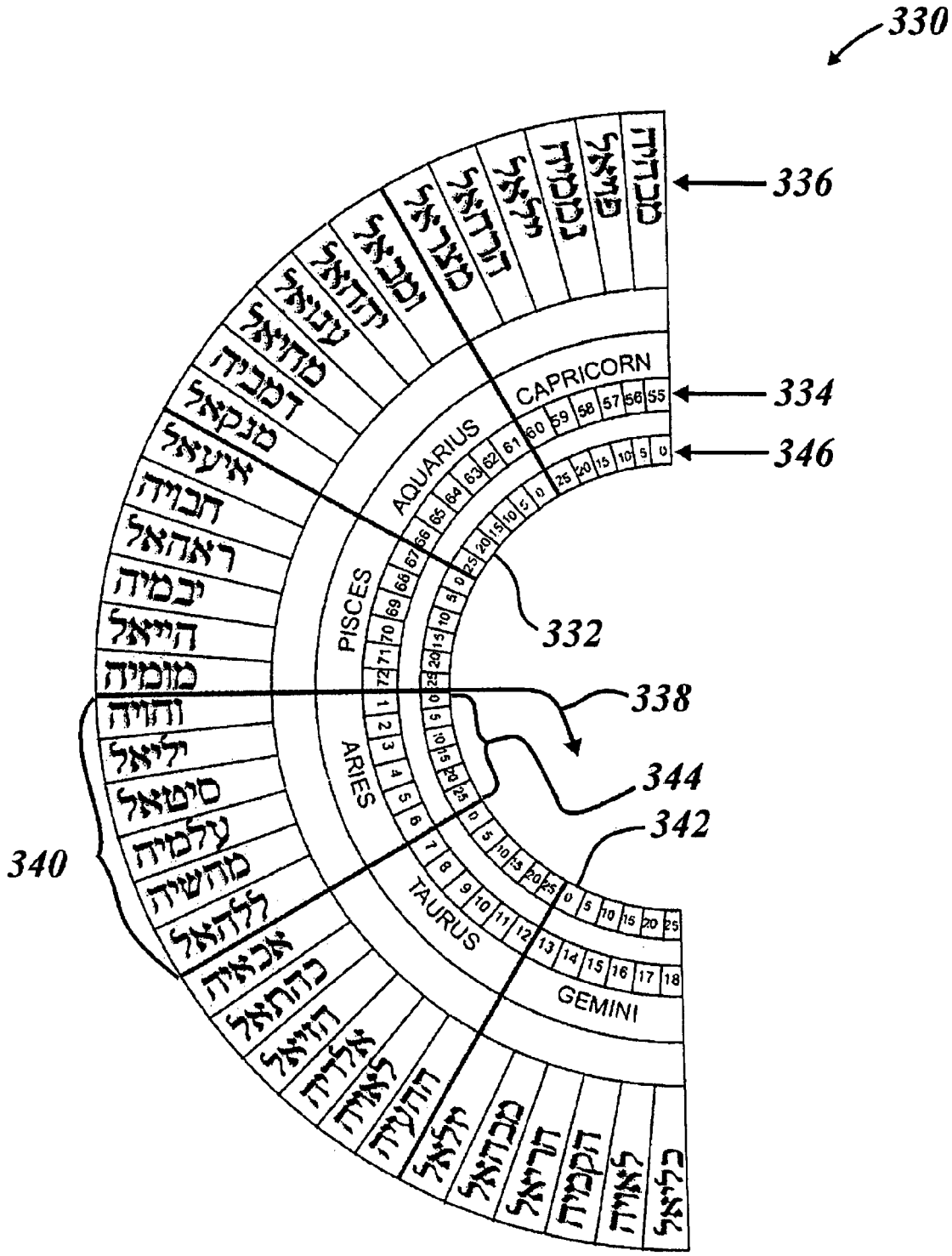
FIG. 8 is a correspondence wheel allowing to find the name of the 72 Names of the Shem ha-Meforash corresponding to the position of a planet on a birth sky, the wheel is cut in half for detailing its content.

Turning now to FIG. 8 where is depicted one-half of a complete mandala-mantra Shem ha-Meforash correspondence wheel 330. The correspondence wheel 330 is helpful in determining the correspondence between a planet from a birth sky and one of the seventy-two (72) Names that were discussed earlier.

The correspondence wheel 330 is separated in seventy-two (72) equal angular sections 332. Each of the seventy-two (72) angular sections is sequentially numbered at radius location 334. Each 72 angular section refers to its associated Name found at radius location 336 as shown on FIG. 7. The sequential numbering 334 starts with the arrow 338, turning counter clockwise. The sequential numbering 334 begins with the first sign of the zodiac as it will be discussed in the following paragraph.

The correspondence wheel 330 also includes 12 even angular separations representing the 12 signs of the zodiac namely, Aries, Taurus, Gemini, Cancer, Leo, Virgo, Libra, Scorpio, Sagittarius, Capricorn, Aquarius and Pisces. Each zodiacal sign comprises six (6) Names 340 and each Name represents five (5) degrees 342 from the three-hundred and sixty degrees (360) birth sky. Thus, each astrological sign comprises six (6) Names and covers thirty (30) degrees angle on the correspondence wheel 330. All the angles are disposed at angular section 346.

Figure 9:
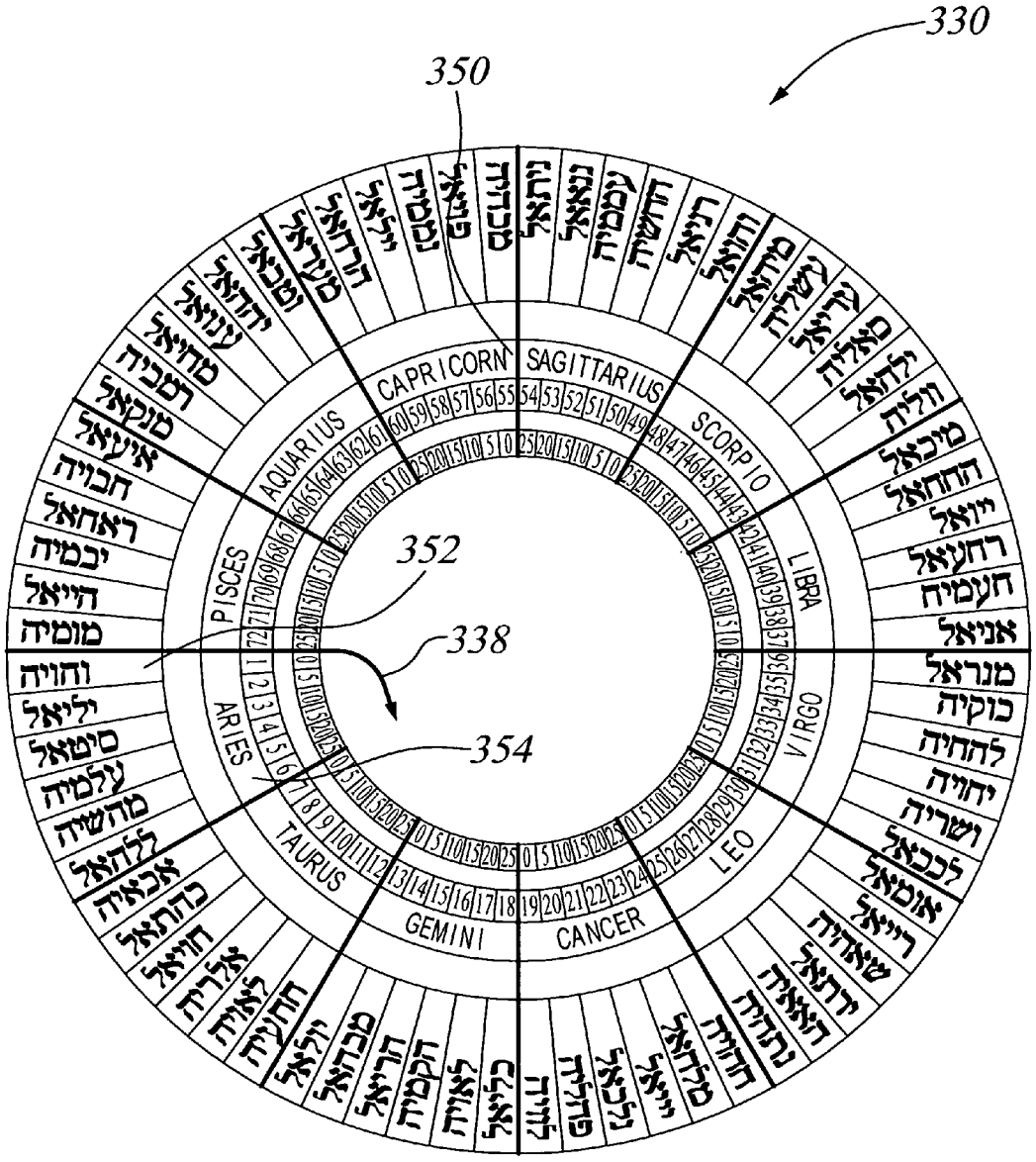
FIG. 9 is a complete correspondence wheel allowing to find the name of the 72 Names of Shem ha-Meforash corresponding to the position of a planet on a birth sky.

FIG. 9 illustrates a complete correspondence wheel 330 that presents all twelve (12) zodiac signs 350 associated thereto. It has to be noted that Name N1 352 begins with the Aries zodiac sign 354 but could also begin with another zodiac sign without departing from the invention.

Figure 10:
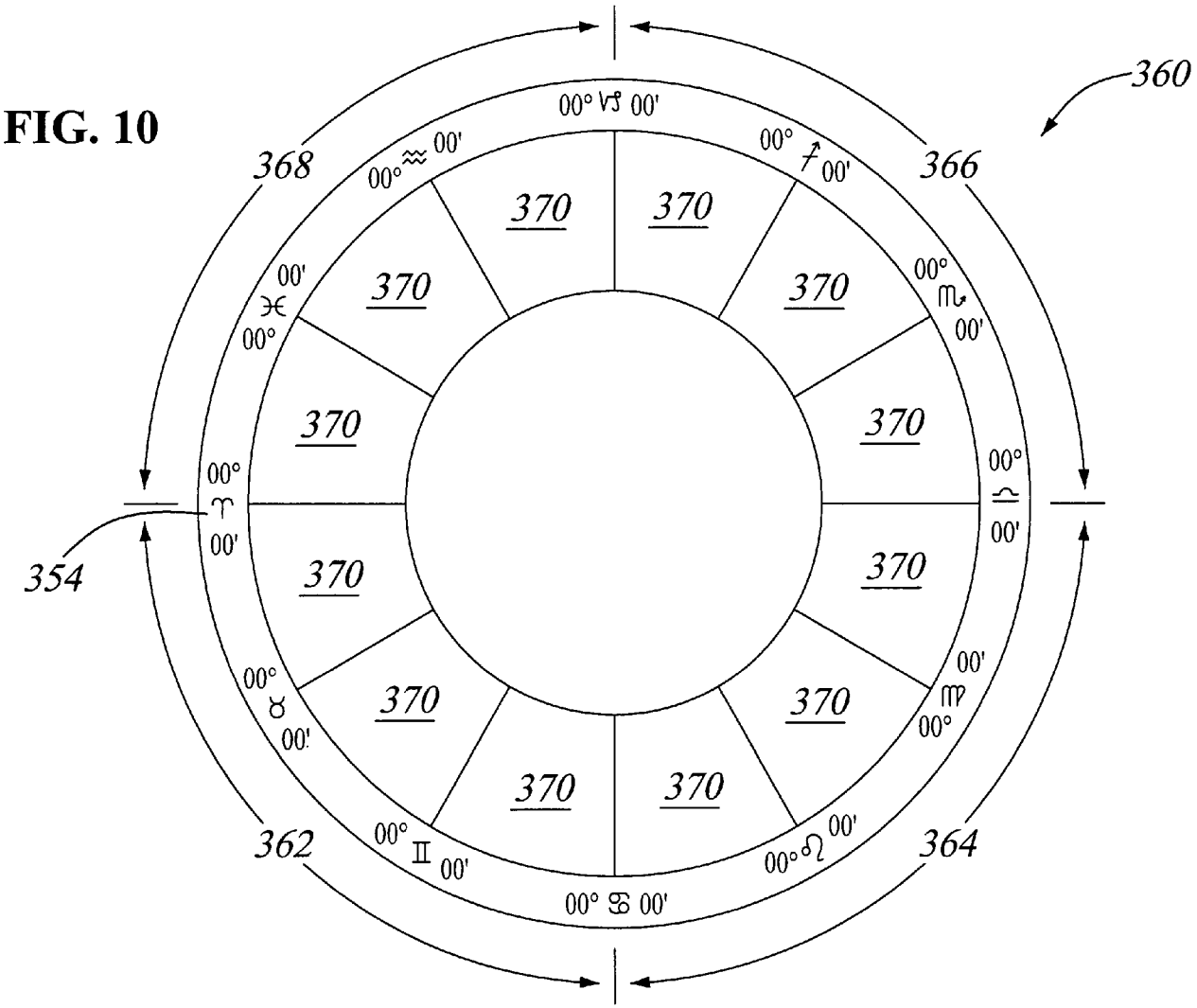
FIG. 10 is a template to draft an astrological birth sky.

FIG. 10 depicts a classic birth sky 360 used in astrology. The birth sky is also called Zodiac. As explained above, the Zodiac denotes an annual cycle of twelve stations along the ecliptic, the apparent path of the sun across the heavens through the constellations that divide the ecliptic into twelve equal zones of celestial longitude. The zodiac is recognized as the first known celestial coordinate system. Babylonian astronomers developed the zodiac of twelve signs. The etymology of the term zodiac is that it comes from the Latin z ōdiacus, from the Greek ζδιακό ς [κύκλο ς], meaning "circle of animals", derived from ζ□διον, the diminutive of ζον "animal". However, the classical Greek zodiac also includes signs (also constellations) that are not represented by animals (e.g., Aquarius, Virgo, Gemini and for some Libra). Another suggested etymology is that the Greek term is cognate with the Sanskrit sodi, denoting "a path", i.e., the path through which the Sun travels.

The zodiac also means a region of the celestial sphere that includes a band of eight arc degrees above and below the ecliptic, and therefore encompasses the paths of the Moon and the naked eye planets (Mercury, Venus, Mars, Jupiter, and Saturn). The classical astronomers called these planets wandering stars to differentiate them from the fixed stars of the celestial sphere (Ptolemy). Astrologers understood the movement of the planets and the Sun through the zodiac as a means of explaining and predicting events on Earth.

By convention the Aries sign 354 begins at the beginning of the first quadrant 362 preceding the second quadrant 364, the third quadrant 366 and the fourth quadrant 368. Similarly to the correspondence wheel 330, the birth sky is separated every thirty (30) degrees 370. Each zodiacal sign is associated with a separation of thirty (30) degrees. Following is a list of the astral signs with their start angle and their associated symbol:

Aries (0°) The Ram ♈
Taurus (30°) The Bull ♉
Gemini (60°) The Twins ♊
Cancer (90°) The Crab ♋
Leo (120°) The Lion ♌
Virgo (150°) The Virgin ♍
Libra (180°) The Scale ♎
Scorpio (210°) The Scorpion ♏
Sagittarius (240°) The Archer ♐
Capricorn (270°) The Sea-goat ♑
Aquarius (300°) The Water-bearer ♒
Pisces (330°) The Fish ♓

From the description of the correspondence wheel 330 and the birth sky 360 one can appreciate that there are several similarities: Both the correspondence wheel 330 and the birth sky 360 are provided on a circle of three hundred and sixty degrees angle (360°), they are separated every thirty degrees (30°) in association with a zodiac sign and the logical suite of the zodiac signs are respected by beginning with the Aries on the first quadrant 362.

The position of the planets on one's birth sky 360 will be transposed to the correspondence wheel 330. The respective positions of the planets on the correspondence wheel 330 will determine which Name of Shem ha-Meforash is associated with each planet.

Application of the Mandala-Mantra Correspondence Wheel

Figure 11:
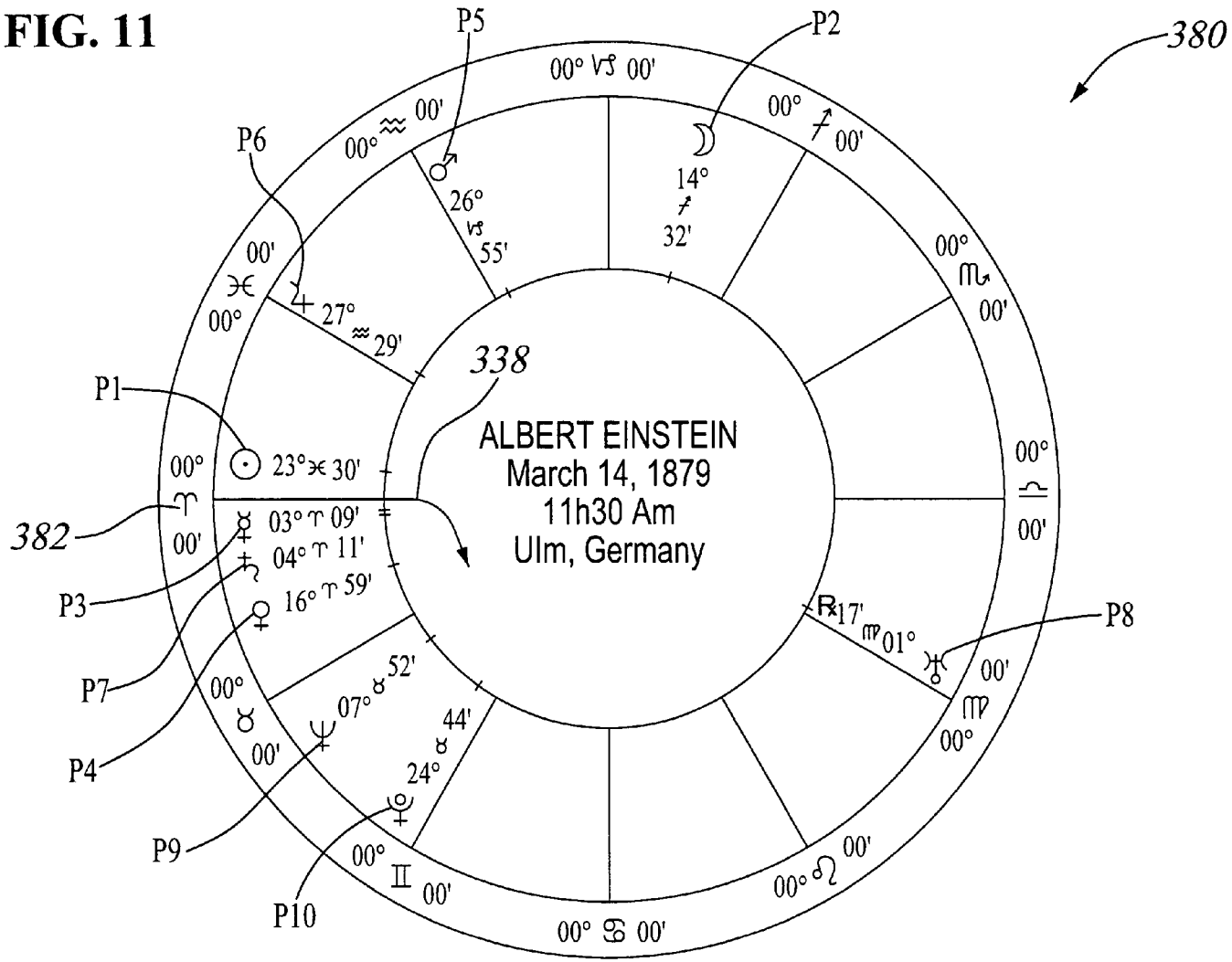
FIG. 11 is the birth sky of Mr. Albert Einstein applied on the template of FIG. 10.

Following with the foregoing explanations here is a concrete example of how is applied the mandala-mantra correspondence wheel. Mr. Albert Einstein has been selected among various historical significant people to build the following example. Mr. Einstein was born in Ulm, Germany on Mar. 14, 1879 at 11:30 AM. FIG. 11 illustrates the birth sky 380 of Mr. Einstein.

Beginning with the Aries 382, in accordance with arrow 338, Mr. Einstein's position of the planets reads as follows:

P1, Sun, 23°30' in Pisces;
P2, Moon, 14°32' in Sagittarius;
P3, Mercury, 03°09' in Aries;
P4, Venus, 16°, 59' in Aries;
P5, Mars, 26°55' in Capricorn;
P6, Jupiter, 27°29' in Aquarius;
P7, Saturn, 04°11' in Aries;
P8, Uranus, 01°17' in Virgo;
P9, Neptune, 07°52' in Taurus;
P10, Pluto, 24°44' in Taurus.

Figure 12:
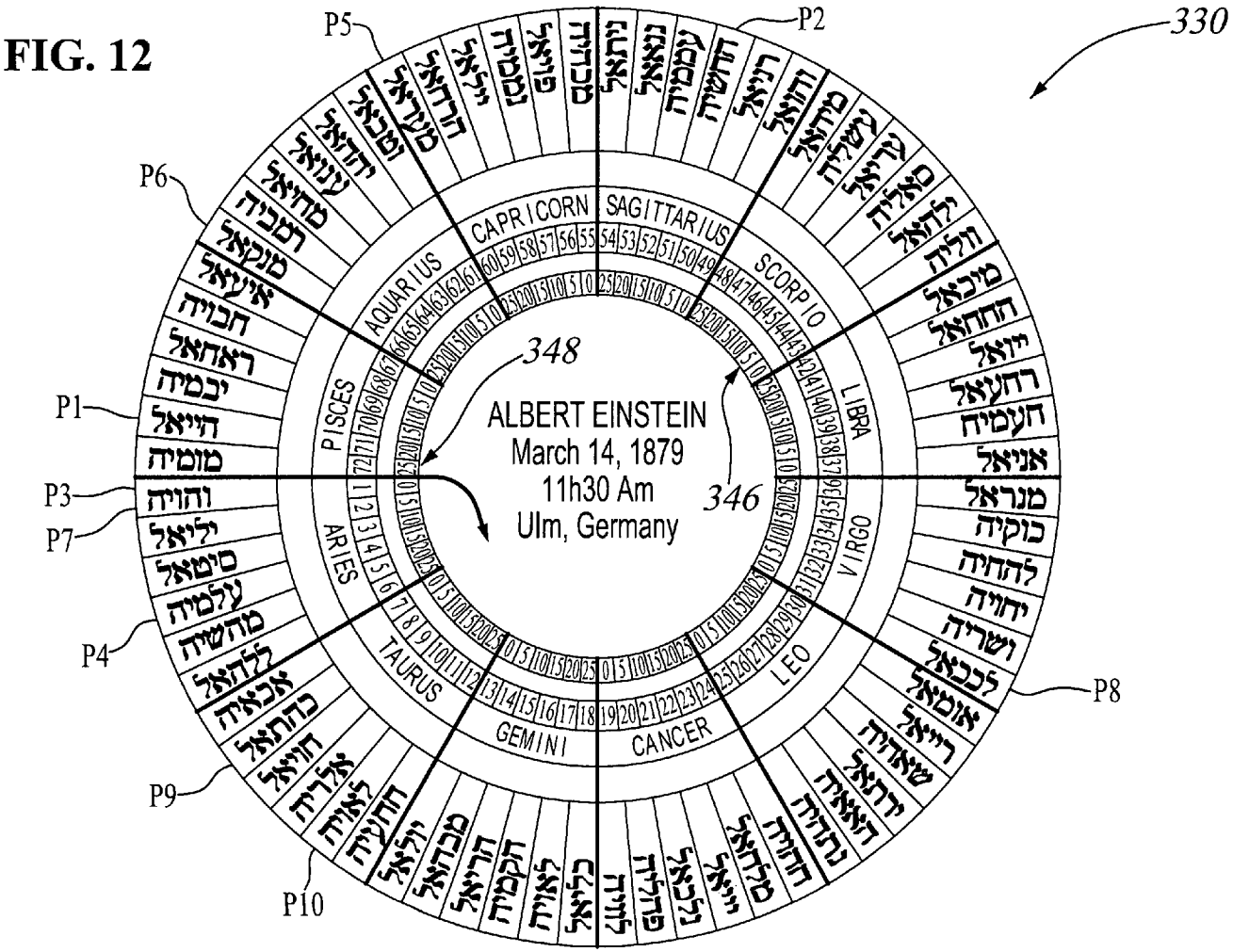
FIG. 12 is the correspondence wheel of FIG. 9 applied to the birth sky of Mr. Albert Einstein.

Turning now to FIG. 12 is shown the application of the planets' positions of Mr. Einstein's birth sky from FIG. 11 to the mandala-mantra correspondence wheel 330. Each planet is reported in the appropriate astral sign with their respective angle reported in the angular section 346. For instance, Planet P1, the Sun, is at 23°30' in Pisces relates to the angular section covering the angular range between 20° and 25° 348. The angular range between 20° and 25° 348 refers to Name P1. From there it is possible to repeat the same procedure to extract the ten (10) Names from the Shem ha-Meforash to produce the individualized mantra. The ten Names are identified as follows with their corresponding planets:

P1, Sun, 23°30' in Pisces=Name 71;
P2, Moon, 14°32' in Sagittarius=Name 51;
P3, Mercury, 03°09' in Aries=Name 1;
P4, Venus, 16°, 59' in Aries=Name 4;
P5, Mars, 26°55' in Capricorn=Name 25;
P6, Jupiter, 27°29' in Aquarius=Name 66;
P7, Saturn, 04°11' in Aries=Name 1;
P8, Uranus, 01°17' in Virgo=Name 31;
P9, Neptune, 07°52' in Taurus=Name 8;
P10, Pluto, 24°44' in Taurus=Name 11.

Figure 13:
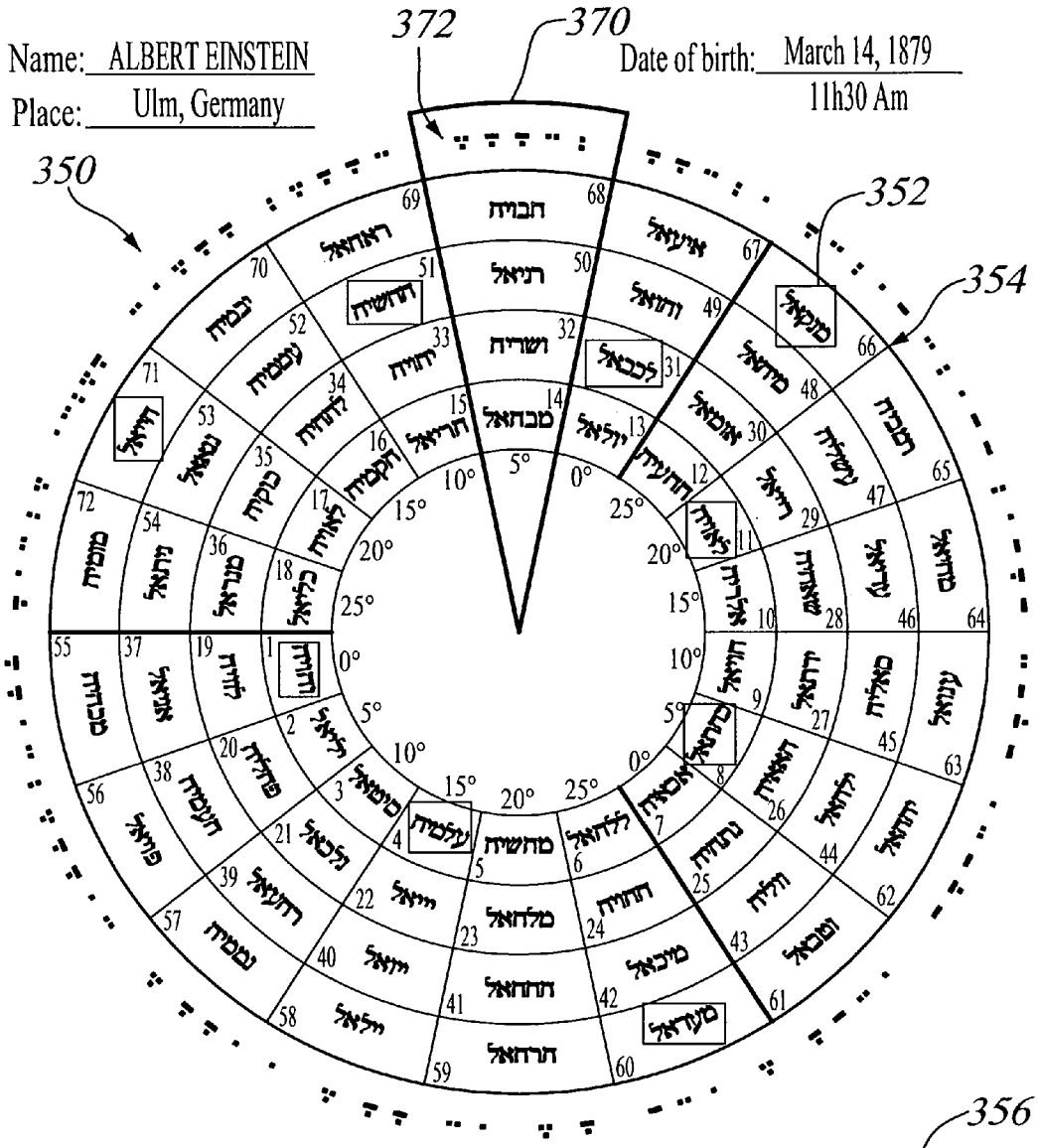
FIG. 13 is a schematic display of the Names of Shem ha-Meforash corresponding to the position of the planets on the birth sky of Mr. Albert Einstein with the corresponding associated vowels.

FIG. 13 is another schematic representation 350 of the Names of Shem ha-Meforash wherein the Names related to the birth sky of Mr. Einstein are illustrated in square boxes 352. Each Name is associated with its respective Name number 354. The extracted data is also shown below in a table format 356.

It can be appreciated that each ray 370 of the Names representation 350 is associated with its related Hebraic vowels 372. The order of the Hebraic letters of each Name is adapted to be associated with the vowels ordering shown in their respective ray 370. The association of the Names with the vowels is going to be discussed later in more details.

The Mandela

The mandala of the present invention is a graphical layout of planets. One possible layout of planets is illustrated on FIG. 14. Eight planets are disposed on the periphery of the circle 380 while two planets are disposed in the center 382 of the circle. Other embodiments providing other geometrical layouts of planets, or simply another sequential ordering of the planets on the circle 382, are encompassed by the present invention.

Figure 14:
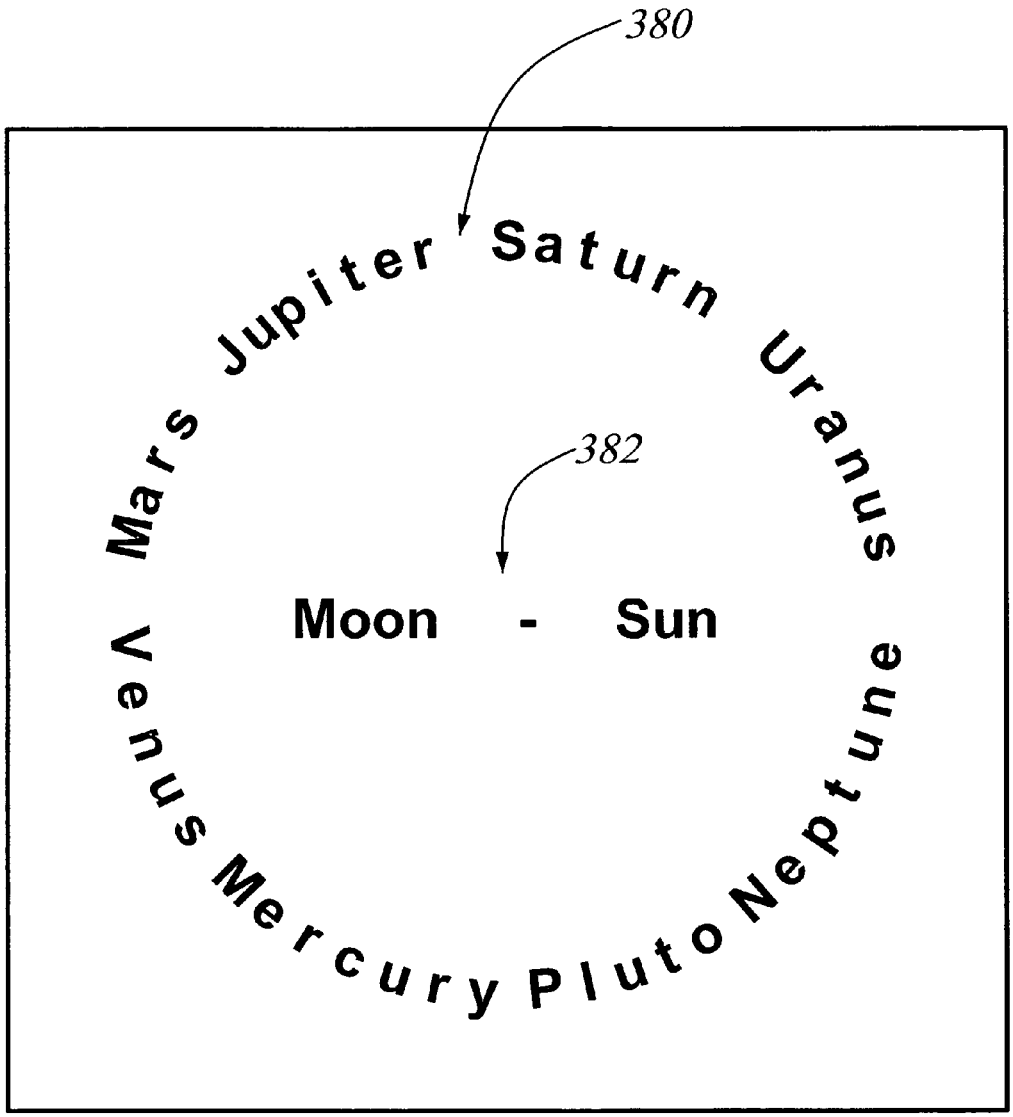
FIG. 14 is a schematic representation of the geometric distribution of the planets in accordance with the mandala.
Figure 15:
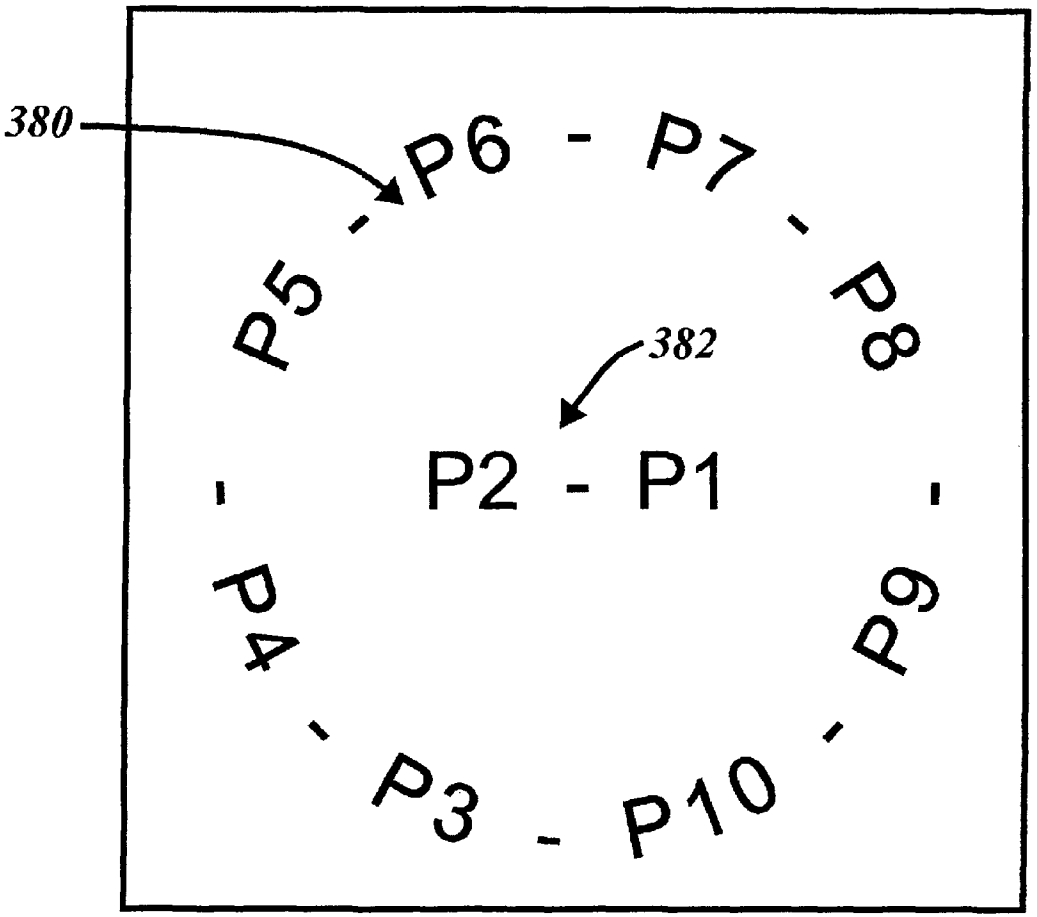
FIG. 15 is a schematic representation of the distribution of 10 Names of Shem ha-Meforash in accordance with the mandala.

Switching to FIG. 15 where is depicted the planet layout of FIG. 14 where the planet names are replaced by their corresponding P numbers. When the Names found for Mr. Einstein on FIG. 13 are disposed in accordance with the planets layout of FIG. 14 it gives the basic mandala 390 of Mr. Einstein as it is illustrated on FIG. 16. The circle layout 380 is bordered with two squares 392 and 394, rotated 90° from each other.

Figure 16:
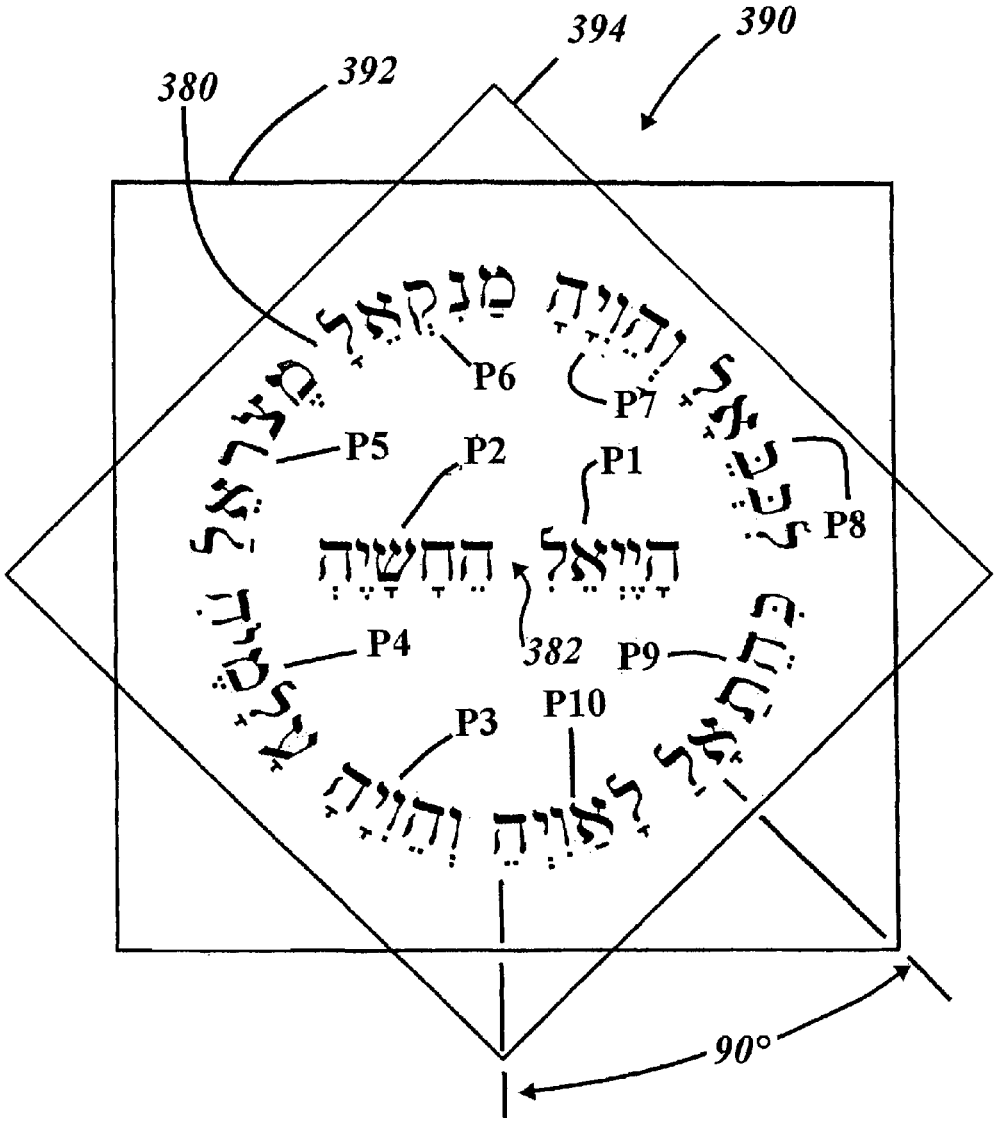
FIG. 16 is a mandala including the 10 Names of Shem ha-Meforash corresponding to the position of the planets on the birth sky of Mr. Albert Einstein with the corresponding associated vowels associated therewith.
Figure 17:
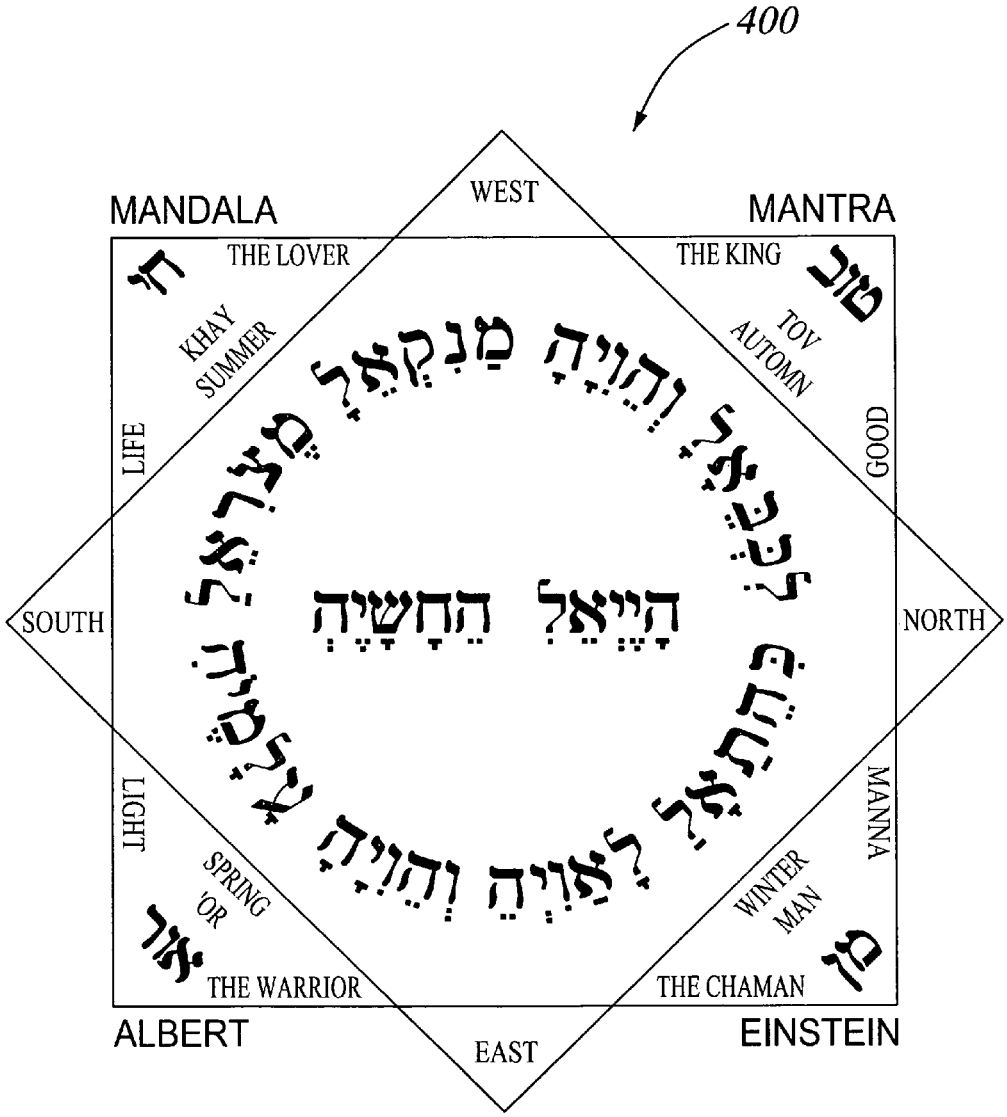
FIG. 17 is an augmented version of the mandala of FIG. 16.

An expanded mandala version 400 is illustrated on FIG. 17 in addition to the basic mandala 390 of FIG. 16. The expanded mandala 400 includes the following additional elements over the basic mandala 390. These elements are designed to help the individual regarding the utilization of his or her mandala-mantra.

The Vowels Transposition

The Names of Shem ha-Meforash are built only with consonants and are therefore not really pronounceable. Vowels are missing to produce a coherent sound when vocalizing the Names. The present invention uses a passage of Genesis to borrow a suite of vowels and apply predetermined sequences of vowels to the Names such that it is possible to vocalize them. The vocalization of each of the Names does not relate to any language in particular. The vocalization produces a sound that is therefore a universal carrier for a specific arrangement of sound frequencies that can be used independently of one's language.

In the present illustrative example the well known passage of Genesis 1:1 is used. Genesis 1:1 is the first Bible verse of the first chapter in the Book of Genesis, and contains the first words of the Bible. The verse begins the account of creation according to Genesis and its translation and interpretation is a major theological issue. The first word in the original Hebrew is בְּרֵאשִׁית,transliterated as Bereishit, B'reishit, or Breishis. In Judaism it begins the Torah portion (parshah) Bereishit, which ends at Genesis 5:31. In Hebrew, בְּרֵאשִׁיתtranslates literally as "At/in [the] head [of]," implying "in [the] beginning." The three middle letters of the Hebrew alphabet within the word בְּרֵאשִׁית,Bereishit, are רא and ש, which are pronounced as reish when part of the word, but can also be read as rosh when read without the vowels. Rosh is the word for "head" as spelled and pronounced in Hebrew (as in Rosh Hashanah, ראש השנה, ro'sh hash-shānāh, "the head (beginning) [of] the year").

The word "Genesis" in English is from the Greek word Γένεσις, having the meanings of "birth," "creation," "cause," "beginning," "source," and "origin."

The vocalized version of the Masoretic text is illustrated on FIG. 18.

As illustrated on FIG. 19, the unvocalized version reads as follows: בראשית ברא אלהיאת השמים ואת הארץ (to be exceptionally read from left to right) transliterated: Bereishit bara Elohim et hashamayim ve'et ha'aretz. Word-by-word literal equivalent: (In the) beginning created God the heavens and the earth. Note: The word et (אֵת)is a Hebrew particle that points to the direct object that it comes in front of. The word ha (preceding shamayim and aretz) is a definite article equivalent to the English definite the.

FIG. 20 depicts the isolated vowels 470 from Genesis 1:1 with their respective associated V number 472 and their respective sounds 474.

Referring now to FIG. 21 is shown groups or five (5) consecutive vowels (e.g. V1-V5). Each group of five vowels is numbered in column 480, followed by the V numbers identifying the respective suite of five (5) vowels 482, followed by the V number and the name of the vowels 484 and finally the sound of each vowel 486. These sounds 486 are used with their related Names to vocalize them.

The table illustrated on FIG. 22 indicates which group of five vowels 480 is associated with which Names 490 from FIG. 7. The association between a group of five vowels 480 and some Names 490 is made on a sequential basis beginning from the first Name to the last. Since there is eighteen groups of vowels 480 extracted from Genesis 1:1, the seventy-two (72) Names are equally divided in four (4) thus assigning four Names for each group of five vowels 480. In FIG. 22, each row reports to four (4) Names. For example, the first group of vowels 492 refers to Names N1, N19, N37 and N55. This means each of the Names N1, N19, N37 and N55 will be vocalized using the first set of five vowels extracted from Genesis 1:1. The same dynamic is applied to vocalization of the remaining Names in accordance with the table of FIG. 22. Other association between the Names and the vowels are possible and are considered to remain within the scope of the present invention.

The Mantra

Figure 23A:
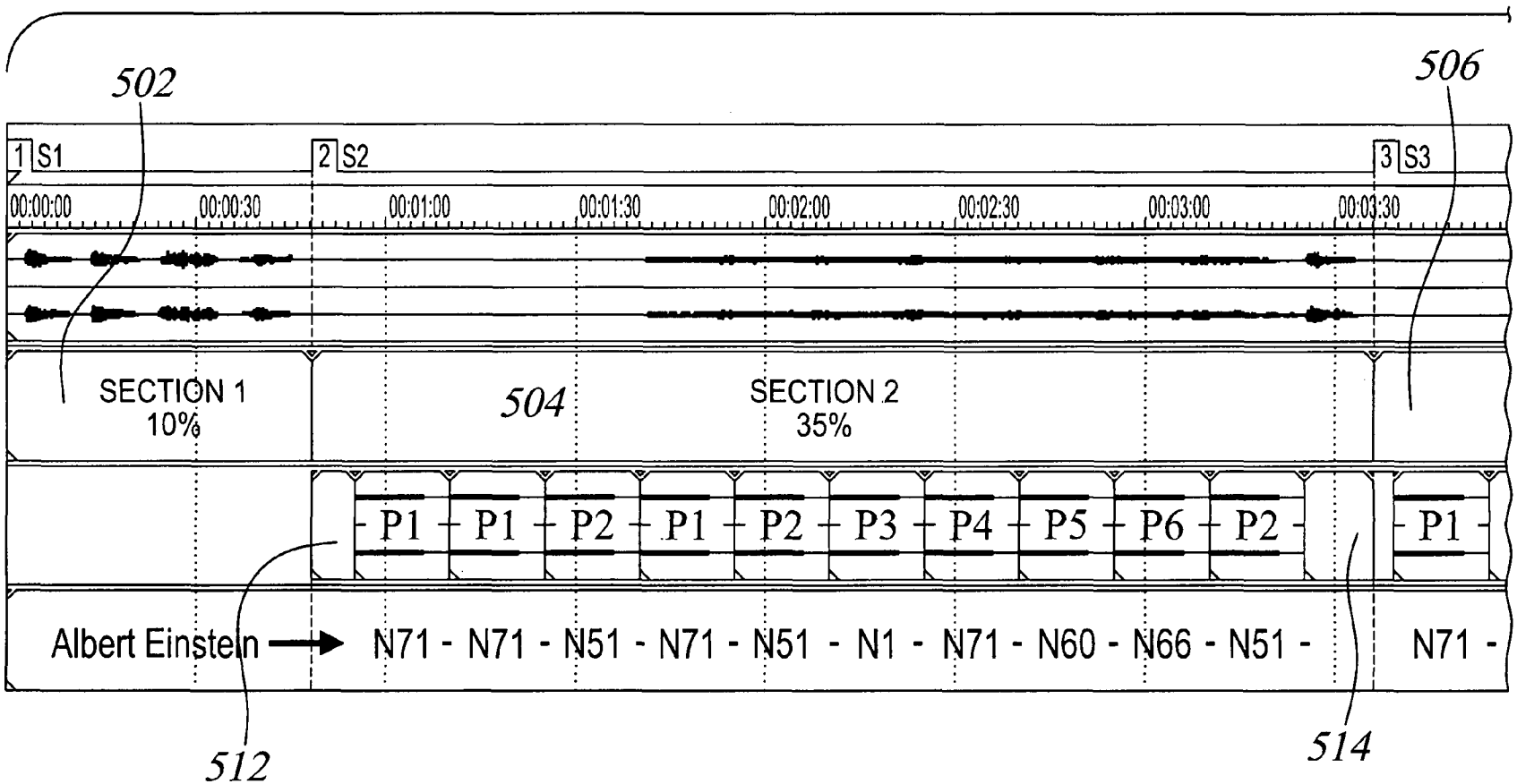
FIG. 23 is a sound timeline of a mantra illustrating the distribution of the vocalized Names of the Shem ha-Meforash.
Figure 23B:
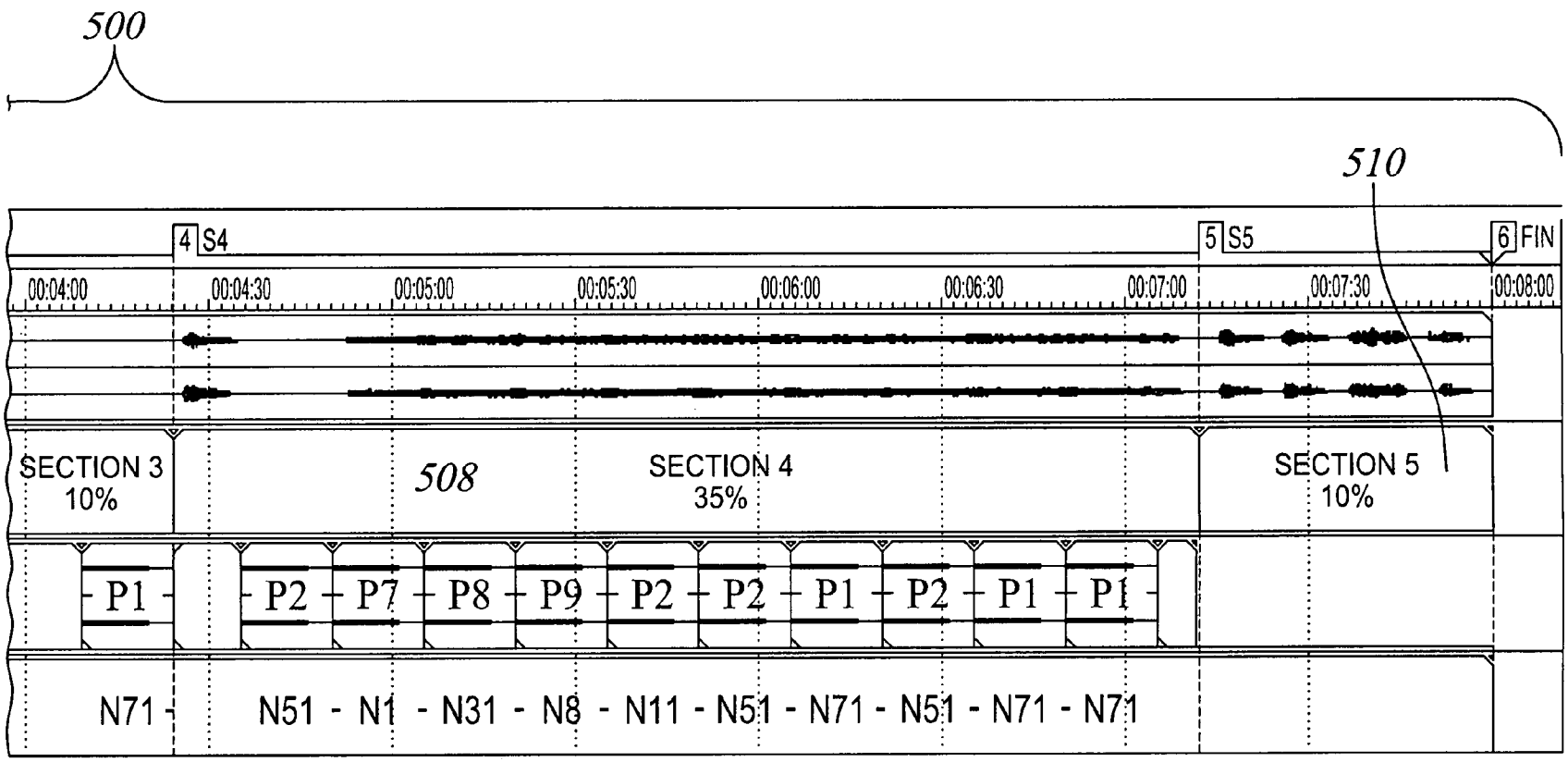

The mantra is built using a predetermined sequence of vocalized Names. FIG. 23 illustrates a timeline 500 of a mantra. The timeline 500 is separated in 5 sections 502, 504, 506, 508 and 510 in the present embodiment. A different number of sections having different lengths can be used in other possible embodiments. The first section 502 is a section recuperating no vocalized Names. Section 2 504 uses a series of vocalized Names based on the planets P numbers as explained above. In the present situation, section 2 504 uses non-vocalized portions 512, 514 at the beginning and the end. Between non-vocalized portions 512, 514, a sequence of planets P1, P1, P2, P1, P2, P3, P4, P5, P6 and P2, with their associated Names, is used.

In accordance with Mr. Einstein's example, the sequence of vocalized Names of section 2 504 would be associated as follows:

| Planets | Mr. Einstein's Names |
|---|---|
| P1 | N71 |
| P1 | N71 |
| P2 | N51 |
| P1 | N71 |
| P2 | N51 |
| P3 | N1 |
| P4 | N71 |
| P5 | N60 |
| P6 | N66 |
| P2 | N51 |

Still according with Mr. Einstein's example, the sequence of vocalized Names of section 3 506 would be associated as follows:

| Planets | Mr. Einstein's Names |
|---|---|
| P1 | N71 |
| None | None |
| P1 | N71 |

In accordance with Mr. Einstein's example, the sequence of vocalized Names of section 4 508 would be associated as follows:

| Planets | Mr. Einstein's Names |
|---|---|
| P2 | N51 |
| P7 | N1 |
| P8 | N31 |
| P9 | N8 |
| P10 | N11 |
| P2 | N51 |
| P1 | N71 |
| P2 | N51 |
| P1 | N71 |
| P1 | N71 |

A musical background produces the body of the mantra. The vocalized Names, that are selected based on the birth date of the person, are pasted over the musical background. The assembled background and vocalized Names are forming the personalized mantra. An exemplary audio file of Mr. Albert Einstein is available on the Internet at the following URL: http://www.mandala-mantra.com/Brevet/Fichier/einstein/audio.

The mantra is provided in various durations. For example, durations of 8, 12, 16 and 20 minutes can be produced using the above-described method.

Additional Potentially Claimable Subject Matter

A client-server interaction for generating a music file using a date of birth, the interaction comprising: entering a birth date on a client; selecting a plurality of Names from the 72 Names of the Shem ha-Meforash based, at least in part, on the birth date; generating a music file with the selected plurality of Names; and downloading the music file to the client.

The client-server interaction for generating a music file of a preceding claim, comprising: displaying a price with the client; and paying the price prior to downloading.

The method for creating a personal mandala of a preceding claim, wherein the method further comprises: defining a first set of portions; assigning the at least one sequence of characters with the portions of the first set; defining a second set of portions in association with the first set of portions; assigning at least one astrological sign to each portion of the second set; associating at least one celestial object to the second set of portions based, at least in part, on a position of celestial objects from a birth sky based on the birth date; and inferring at least one sequence of characters from the position of each of the celestial objects on the portions of the first set.

The method for creating a personal mandala of a preceding claim, wherein the method further comprises: distributing the first set of portions on a circle to define 72 angular name portions; assigning 72 Names of Shem ha-Meforash with the 72 angular name portions; distributing the second set of portions in 12 angular astrological sign portions on the circle, each angular sign portion comprising 6 angular name portions; assigning 12 astrological signs with the 12 angular astrological sign positions, respectively; associating 10 celestial objects of the birth sky, with their respective angle, on the circle; and inferring 10 sequences of characters with the positions of the 10 celestial objects, wherein the at least one sequence of characters is a Name of Shem ha-Meforash.

The method for creating a personal mandala of a preceding claim, wherein an Aries astrological sign begins, counter clock wise, with a third quadrant of the circle and the other astrological signs are following in their chronological order.

The method for creating a personal mandala of a preceding claim, comprising displaying the 10 inferred Names of Shem ha-Meforash with the graphical layout.

The method for creating a personal mandala of a preceding claim, wherein the graphical layout is a circle layout with the 10 celestial objects disposed thereon.

The method for creating a personal mandala of a preceding claim, wherein at least 8 of the 10 celestial objects are equidistantly disposed on a periphery of the circle layout.

The method for creating a personal mandala of a preceding claim, wherein the at least 8 celestial objects disposed on the periphery of the circle layout are evenly disposed above and below an upper and a lower half of the circle layout.

The method for creating a personal mandala of a preceding claim, wherein the at least 8 celestial objects disposed on the periphery of the circle layout are evenly disposed on a right side and a left side of the circle layout.

The method for creating a personal mandala of a preceding claim, wherein the circle layout includes 2 celestial objects disposed in its center.

The method for creating a personal mandala of a preceding claim, wherein the 2 celestial objects disposed in the circle layout center are a sun and a moon.

The method for creating a personal mandala of a preceding claim, wherein each of the 10 Names of Shem ha-Meforash are associated with a set of 5 vowels taken from Genesis.1:1 in Hebrew.

A mandala comprising: a first square; a second square superposed on the first square with about a 45 degrees rotation; 8 Names of the Shem ha-Meforash disposed on a periphery of a circle layout disposed and centered in the first and the second square; and 2 Names of the Shem ha-Meforash disposed in a center of the circle layout. The mandala of claim 12, wherein Hebrew vowels are associated with the Names of the Shem ha-Meforash disposed on the circle layout.

The mandala of a preceding claim, wherein the Hebrew vowels are taken from Genesis.1:1 in Hebrew.

The mandala of a preceding claim, wherein the Hebrew vowels are five consecutive vowels from Genesis.1:1 in Hebrew.

The mandala of a preceding claim, wherein four cardinal directions are associated with four corners of the second square.

The mandala of a preceding claim, wherein four seasons are associated with four sides of the second square.

The mandala of a preceding claim, wherein diagonals across opposite corners of the first square are respectively associated with a King-Warrior axis and a Lover-Chaman axis.

The mandala of a preceding claim, wherein the mandala further comprises at least one of the words Light, Life, Good and Manna.

A personalized mandala comprising a group of Names taken from 72 Names of the Shem ha-Meforash, the group of Names being selected on the basis of the position of the celestial objects in one's birth sky, at least a portion of the Names being disposed in a geometric fashion.

The personalized mandala of a preceding claim, wherein the group of Names is a group of 10 Names, the position of the celestial objects is the position of 10 celestial objects in one's birth sky, the geometric fashion is a circle and wherein at least some of the 10 Names are disposed inside the circle.

The personalized mandala of a preceding claim, wherein at least some of the Names are associated with vowels extracted from Genesis.1:1 in Hebrew.

The method of a preceding claim, wherein the vowels are extracted from Genesis.1:1, in Hebrew.

The method of a preceding claim, wherein the mantra is personalized by selecting the plurality of Names in conjunction with a birth date.

The method for creating a mantra of a preceding claim, wherein the plurality of Names is 10 Names.

The method for creating a mantra of a preceding claim, wherein the vowels are groups of consecutive vowels extracted from Genesis.1:1 in Hebrew.

The method for creating a mantra of a preceding claim, wherein the plurality of Names are disposed in a predetermined sequence over a duration of the mantra.

The method for creating a mantra of a preceding claim, wherein the plurality of Names are selected, at least in part, by a correlation between a position of planets in one's birth sky and the 72 Names of Shem ha-Meforash.

The method for creating a mantra of a preceding claim, wherein the correlation between the position of the planets in one's birth sky and the 72 Names of Shem ha-Meforash is provided by: separating 360 degrees of a circle in 72 angular name portions of 5 degrees each; assigning 72 Names of Shem ha-Meforash with the 72 angular name portions of the circle; separating the 360 degrees of the circle in 12 angular astrological sign portions of 30 degrees each, each angular sign portion comprising 6 angular name portions; assigning 12 astrological signs with the 12 angular astrological sign positions, respectively; associating 10 planets of a birth sky, with their respective angle, on the circle; and inferring 10 Names of Shem ha-Meforash with the positions of the 10 planets.

The method for creating a mantra of a preceding claim, wherein the mantra is available in various durations.

The method for creating a mantra of a preceding claim, wherein the mantra further comprises an opening and a finale.

The method for creating a mantra of a preceding claim, wherein there is a repetition of at least one name in the mantra.

The method for creating a mantra of a preceding claim, wherein there is a silent portion within the duration of the mantra.

An individualized mantra comprising a sequence of Names selected from 72 Names of Shem ha-Meforash coupled with sequences of vowels extracted from Genesis.1:1.

The individualized mantra of a preceding claim, wherein the sequence of Names comprises 10 Names.

The individualized mantra of a preceding claim, wherein the vowels are groups of consecutive vowels extracted from Genesis.1:1 in Hebraic language.

The individualized mantra of a preceding claim, wherein the Names are disposed in a predetermined sequence over a duration of the mantra.

The individualized mantra of a preceding claim, wherein the Names are selected, at least in part, by a correlation between a position of planets in one's birth sky and the 72 Names of Shem ha-Meforash.

The individualized mantra of a preceding claim, wherein the correlation between the position of the planets in one's birth sky and the 72 Names of Shem ha-Meforash is provided by: defining 72 angular name portions of 5 degrees each; assigning 72 Names of Shem ha-Meforash with the 72 angular name portions; defining 12 angular astrological sign portions of 30 degrees each, each angular sign portion comprising 6 angular name portions; assigning 12 astrological signs with the 12 angular astrological sign positions, respectively; associating 10 celestial objects of a birth sky, with their respective angle; and inferring 10 Names of Shem ha-Meforash with the positions of the 10 celestial objects.

The individualized mantra of a preceding claim, wherein the personalized mantra is available in various durations.

The individualized mantra of a preceding claim, wherein the mantra further comprises an opening and a finale.

The individualized mantra of a preceding claim, wherein there is a repetition of at least one Name in the mantra.

The individualized mantra of a preceding claim, wherein there is a silent portion within the duration of the mantra.

The description and the drawings that are presented above are meant to be illustrative of the present invention. They are not meant to be limiting of the scope of the present invention. Modifications to the embodiments described may be made without departing from the present invention, the scope of which is defined by the following claims:

What is claimed is:

1. A method for creating a personalized musical file comprising:

receiving a birth data;

determining an angular distribution of planets on a birth sky based, at least in part, on the birth data;

selecting a plurality of sequences of characters based, at least in part, on the angular distribution of planets;

generating a recorded musical portion for at least some of the plurality of sequences of characters;

assembling at least some of the recorded musical portions in a musical file; and recording the musical file.

2. The method for creating a musical file of claim 1, wherein the plurality of sequences of characters are Names from Shem ha-Meforash, the method comprising:

associating vowels with at least some of the selected plurality of Names in a fashion that vocalizes the Names.

3. The method for creating a musical file of claim 1, comprising:

receiving a birth place instruction; and receiving a birth time instruction, to more precisely select the plurality of Names.

4. The method for creating a musical file of claim 1, comprising:

defining 72 angular name portions;

assigning 72 Names of Shem ha-Meforash with the 72 angular name portions;

defining 12 angular astrological sign portions, each angular sign portion comprising 6 angular name portions;

assigning 12 astrological signs with the 12 angular astrological sign positions, respectively;

associating 10 celestial objects of the birth sky, with their respective angle; and inferring 10 Names of Shem ha-Meforash from the positions of the 10 celestial objects.

5. The method for creating a musical file of claim 1, wherein the plurality of Names is 10 Names.

6. The method for creating a musical file of claim 1, wherein associating vowels with at least some of the Names is associating vowels with all the Names.

7. The method for creating a musical file of claim 1, wherein vowels are extracted from Genesis.1:1 in the Hebraic language.

8. The method for creating a musical file of claim 7, wherein vowels are grouped in groups of 5 vowels.

9. The method for creating a musical file of claim 8, wherein groups of vowels are in the same sequential order as they are ordered in Genesis.1:1 in the Hebraic language.

10. The method for creating a musical file of claim 1, wherein the music file is available in different versions, each version having a distinct duration.

11. A machine-readable medium including machine-readable instructions providing a method for creating a music file, the method comprising:

receiving a birth date;

determining angular distribution of celestial objects on a birth sky based, at least in part, on the birth date;

selecting a plurality of Names from Shem ha-Meforash based, at least in part, on the angular distribution of celestial objects;

associating vowels with at least some of the Names;

generating a recorded musical portion for at least some of the Names;

assembling at least some of the recorded musical portions in a musical file; and recording the musical file.

12. The machine-readable medium including machine-readable instructions providing a method for creating a music file of claim 11, comprising:

receiving a birth place; and receiving a birth time, to more precisely select the plurality of Names.

13. The machine-readable medium including machine-readable instructions providing a method for creating a music file of claim 11, selecting a plurality of Names from Shem ha-Meforash comprises:

defining 72 angular name portions of 5 degrees each;

assigning 72 Names of Shem ha-Meforash with the 72 angular name portions of the circle;

defining 12 angular astrological sign portions of 30 degrees each, each angular sign portion comprising 6 angular name portions;

assigning 12 astrological signs with the 12 angular astrological sign positions, respectively;

associating 10 planets of the birth sky, with their respective angle; and inferring 10 Names of Shem ha-Meforash with the positions of the 10 celestial objects.

14. The machine-readable medium including machine-readable instructions providing a method for creating a music file of claim 11, wherein the plurality of Names is 10 Names.

15. The machine-readable medium including machine-readable instructions providing a method for creating a music file of claim 11, wherein associating vowels with at least some of the Names is associating vowels with all the Names.

16. The machine-readable medium including machine-readable instructions providing a method for creating a music file of claim 11, wherein vowels are extracted from Genesis.1:1 in the Hebraic language.

17. The machine-readable medium including machine-readable instructions providing a method for creating a music file of claim 16, wherein vowels are grouped in groups of 5 vowels.

18. The machine-readable medium including machine-readable instructions providing a method for creating a music file of claim 17, wherein the music file is available in different versions, each version having a distinct duration.

19. The machine-readable medium including machine-readable instructions providing a method for creating a music file of claim 17, wherein the music file is available in different versions, each version having a distinct duration.

* * * * *